US008453293B1

(12) United States Patent
Monson

(10) Patent No.: US 8,453,293 B1
(45) Date of Patent: Jun. 4, 2013

(54) VACUUM HEAD

(76) Inventor: Clifford L. Monson, Kirkland, WA (US)

( * ) Notice: Subject to any disclaimer, the term of this patent is extended or adjusted under 35 U.S.C. 154(b) by 245 days.

(21) Appl. No.: 13/065,570

(22) Filed: Mar. 24, 2011

(51) Int. Cl.
*A47L 11/00* (2006.01)

(52) U.S. Cl.
USPC ..... 15/322; 15/320; 15/321; 15/385

(58) Field of Classification Search
USPC ..... 15/320, 321, 322, 385, 401
See application file for complete search history.

(56) References Cited

U.S. PATENT DOCUMENTS

| | | | | |
|---|---|---|---|---|
| 2,168,692 | A | 8/1939 | Charles | |
| 3,619,848 | A | 11/1971 | Salzmann | |
| 3,644,960 | A | 2/1972 | Danzig | |
| 3,908,220 | A | 9/1975 | Adamson et al. | |
| 4,127,913 | A | 12/1978 | Monson | |
| 4,182,001 | A | 1/1980 | Krause | |
| 4,264,999 | A | 5/1981 | Monson | |
| 4,333,204 | A | 6/1982 | Monson | |
| 4,339,840 | A | 7/1982 | Monson | |
| 4,441,229 | A | 4/1984 | Monson | |
| 4,692,959 | A | 9/1987 | Monson | |
| 4,731,956 | A | 3/1988 | Wood | |
| 4,788,738 | A | 12/1988 | Monson et al. | |
| 4,930,178 | A | 6/1990 | Monson et al. | |
| 5,289,610 | A | 3/1994 | Monson | |
| 5,392,490 | A | 2/1995 | Monson | |
| 5,517,715 | A | 5/1996 | Monson | |
| 5,706,549 | A | 1/1998 | Legatt et al. | |
| 6,032,326 | A | 3/2000 | Roden et al. | |
| 6,643,894 | B1 | 11/2003 | Dell | |
| 2007/0251047 | A1 * | 11/2007 | Monson | 15/322 |

FOREIGN PATENT DOCUMENTS

| | | |
|---|---|---|
| AU | 2007201721 | 11/2007 |
| GB | 2098446 | 11/1982 |
| GB | 2437484 | 10/2007 |

OTHER PUBLICATIONS

Hydramaster Corporation, Mukilteo, WA, USA, RX-20HE, Web Site Advertising Materials, 2 pages, downloaded Sep. 28, 2010.

USPTO Office Action of Dec. 10, 2010, 10 pages, regarding reference AR.

Australian Examiner's First Report, Oct. 1, 2010, 2 pages, regarding Australian Patent Application No. 2007201721, corresponding to reference AR.

Australian Examiner's Second Report, Feb. 22, 2011, 2 pages, regarding Australian Patent Application No. 2007201721, corresponding to reference AR.

(Continued)

*Primary Examiner* — Mark Spisich
*Assistant Examiner* — Andrew A Horton
(74) *Attorney, Agent, or Firm* — Gregory W. Moravan

(57) ABSTRACT

A vacuum head for a rotary cleaning head is disclosed that has a vacuum port arm defining a vacuum port, and a vacuum slot arm defining a vacuum slot. The vacuum head may be L-shaped, its vacuum port may extend along a radius of the rotary cleaning head, and its vacuum slot may extend in the direction of rotation of the rotary cleaning head. The vacuum slot receives vacuum from the vacuum port, and is operable to vacuum up at least most of any cleaning fluid that collects on the leading side of the vacuum head, to prevent that cleaning fluid from being slung outwardly from the rotary cleaning head. The leading side of the vacuum port arm and the leading end of the vacuum slot arm may be tapered to help the vacuum head ski up and over any fixed obstacles it encounters.

24 Claims, 16 Drawing Sheets

OTHER PUBLICATIONS

UK Intellectual Property Office, 1 page, Jun. 22, 2007, Search Report regarding UK Patent Application No. GB0707660.7, corresponding to reference AR.

UK Intellectual Property Office, 2 pages, Feb. 7, 2011, First Examination Report regarding UK Patent Application No. GB0707660.7, corresponding to reference AR.

USPTO Examiner's Answer of Aug. 7, 2012, 42 pages, regarding copending U.S. Appl. No. 11/731,996.

USPTO Office Action of Aug. 30, 2011, 13 pages, regarding copending U.S. Appl. No. 11/731,996.

USPTO Office Action of May 16, 2011, 12 pages, regarding copending U.S. Appl. No. 11/731,996.

USPTO Office Action of Nov. 9, 2011, 16 pages, regarding copending U.S. Appl. No. 11/731,996.

* cited by examiner

VACUUM HEAD

DETAILED DESCRIPTION OF THE INVENTION

Figure 1:
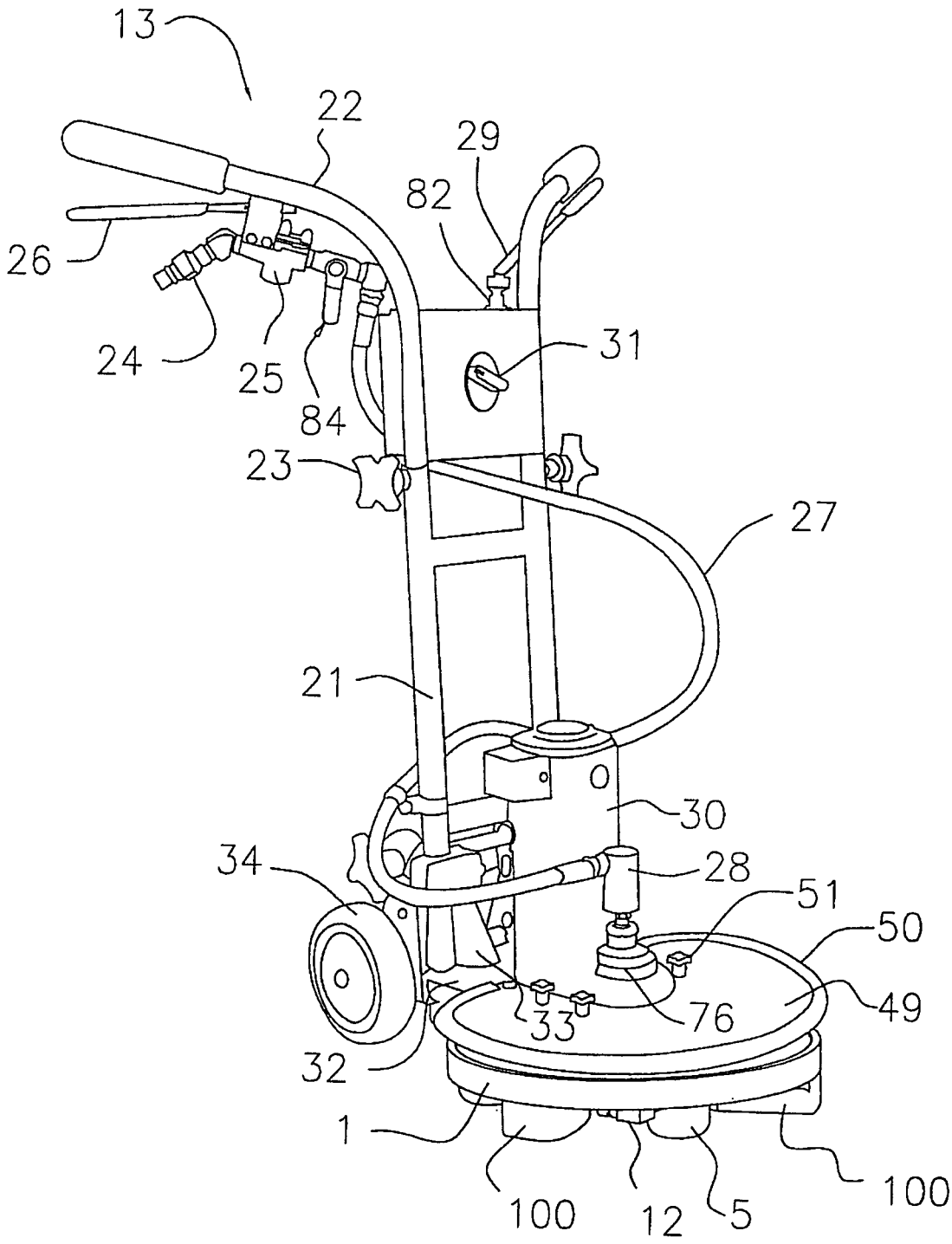
FIG. 1 is a perspective view showing an example floor cleaning machine 13 with which the vacuum heads 100 may be used.

Turning now to FIG. 1, the rotary cleaning head 1 may be used with any suitable floor cleaning machine 13. A conventional floor cleaning machine 13 may typically comprise any suitable frame 21 and a pair of handles 22. The handles 22 may be made height adjustable in any suitable way, such as by telescoping them within frame 21 and selectively locking them in place with any suitable locking mechanism, such as a pair of locking knobs 23.

One of the handles 22 may carry a fluid coupling 24 to which a source of cleaning fluid may be attached. Any suitable cleaning fluid may be used, such as water for example, to which may be added any suitable cleaning agents such as detergents, anti-foam agents, or surfactants, for example.

Any suitable valve mechanism, such as a valve 25 actuated by a control lever 26, may be providing for controlling the flow of cleaning fluid to the rotary cleaning head 1 through a supply line 27 and a rotary fluid coupling 28. Any suitable flow control valve 84 may be provided, if desired, for further control of the flow of cleaning fluid to the rotary cleaning head 1. One of the handles 22 may carry any suitable control, such as a control lever 29 and a switch 82, for starting and stopping a drive motor 30 for the rotary cleaning head 1.

Figure 4:
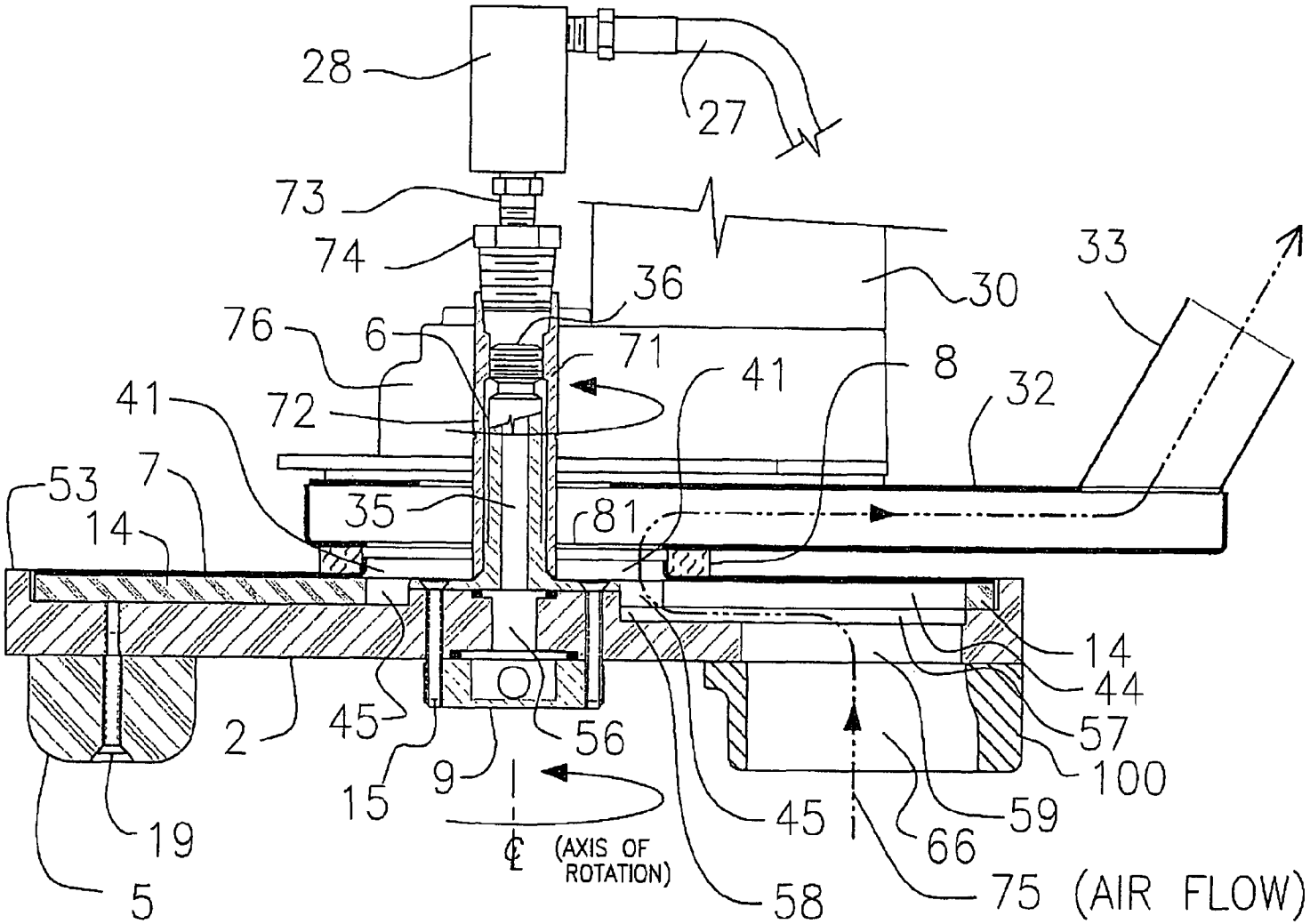
FIG. 4 is a cross-sectional view taken along line 4-4 of FIG. 3.

As best seen in FIG. 4, the drive motor 30 may be attached to the gear box 76, which may be secured to the vacuum plenum 32, which may be secured to the lower part of the frame 21. The speed of the drive motor 30 may be set in any suitable way, in order to control the rotational speed of the rotary cleaning head 1, such as by use of a speed control knob 31 and any suitable associated electrical control circuitry.

Any suitable drive motor 30, gear box 76 and vacuum plenum 32 may be used. The vacuum plenum 32 may have any suitable vacuum coupling 33 (such as the pipe stub 33 illustrated in FIGS. 1 and 4), to which any suitable vacuum source may be attached. The vacuum plenum 32 may provide a source of vacuum for the rotary cleaning head 1, as will be described in more detail below. The vacuum plenum 32 may have any suitable size, shape and construction, as long as its inlet 81 is sized, shaped and located so as to provide an adequate source of vacuum for the vacuum opening 41 in the cover 7 of the rotary cleaning head 1.

As best seen in FIG. 1, an optional bump cover 49, with a resilient rim 50, may be secured to the top of the vacuum plenum 32 in any suitable way, such as with four screw knobs 51. The function of the bump cover 49 may be to help prevent the rotary cleaning head 1 from damaging walls and furnishings during operation, since the resilient rim 50 is slightly larger in diameter than the rotary cleaning head 1.

A pair of wheels 34 may be attached to the lower part of the frame 21 to enable the cleaning machine 13 to be moved more easily. Although not illustrated in FIG. 1 for clarity and simplicity, the cleaning machine 13 may include any suitable mechanism for permitting the handles 22 and at least part of the frame 21 to be tilted at any desired angle with respect to the vacuum plenum 32, for the comfort and convenience of the user.

Figure 11:
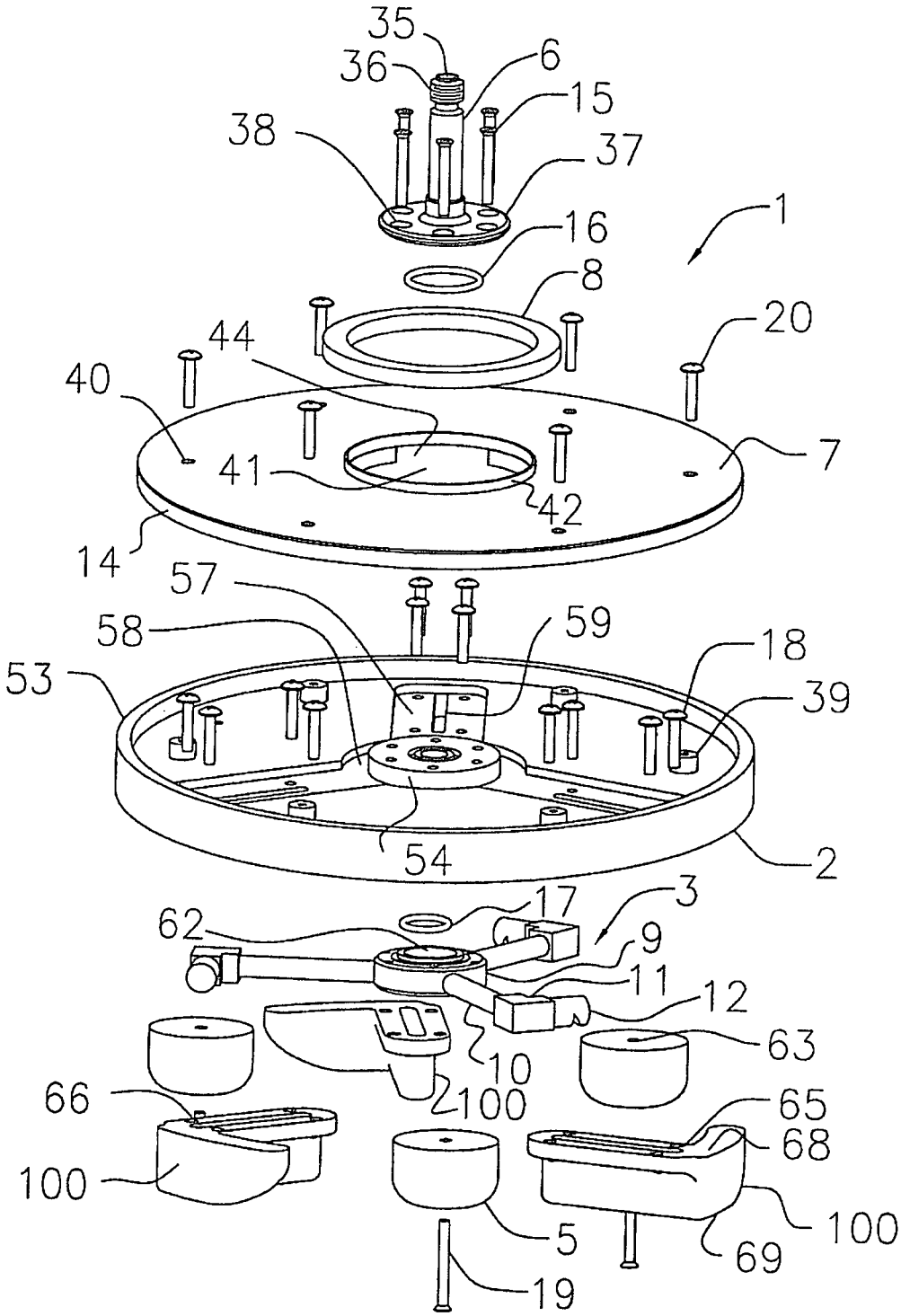
FIG. 11 is an exploded perspective view of the rotary cleaning head 1.
Figure 12:
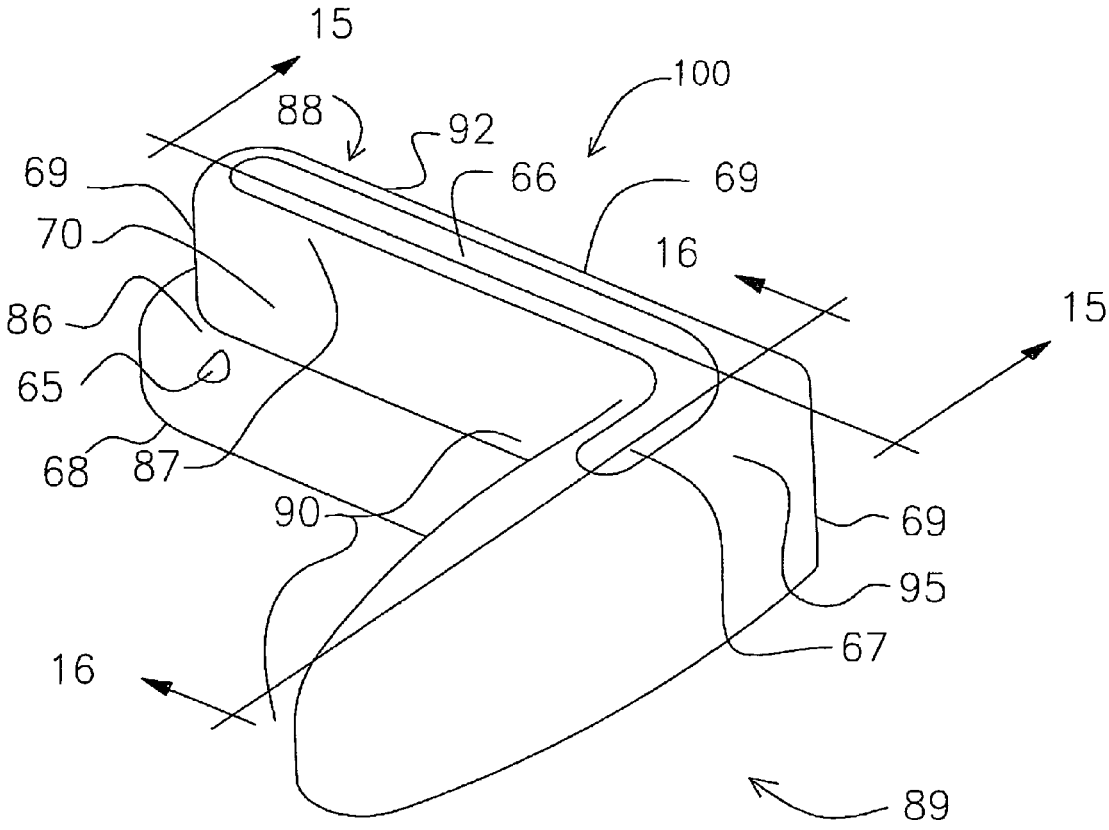
FIG. 12 is a perspective view of the vacuum head 100.
Figure 13:
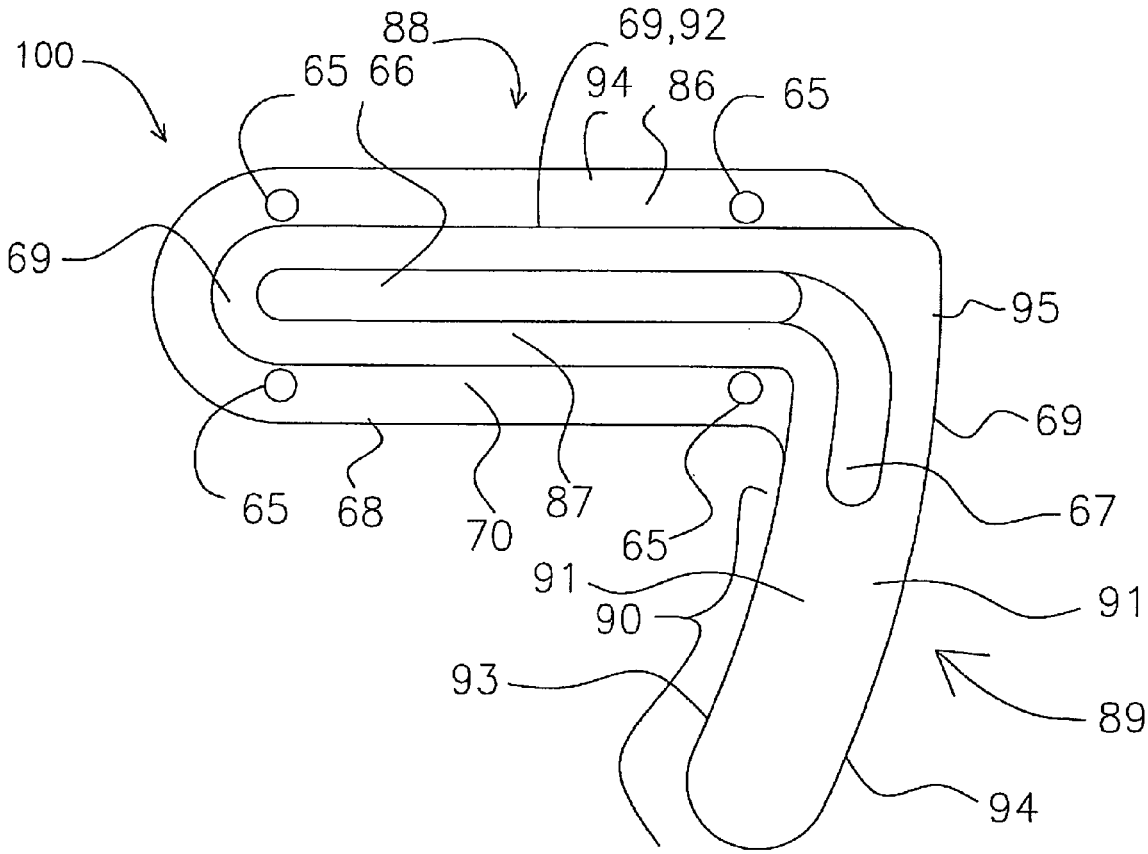
FIG. 13 is a top plan view thereof.
Figure 14:
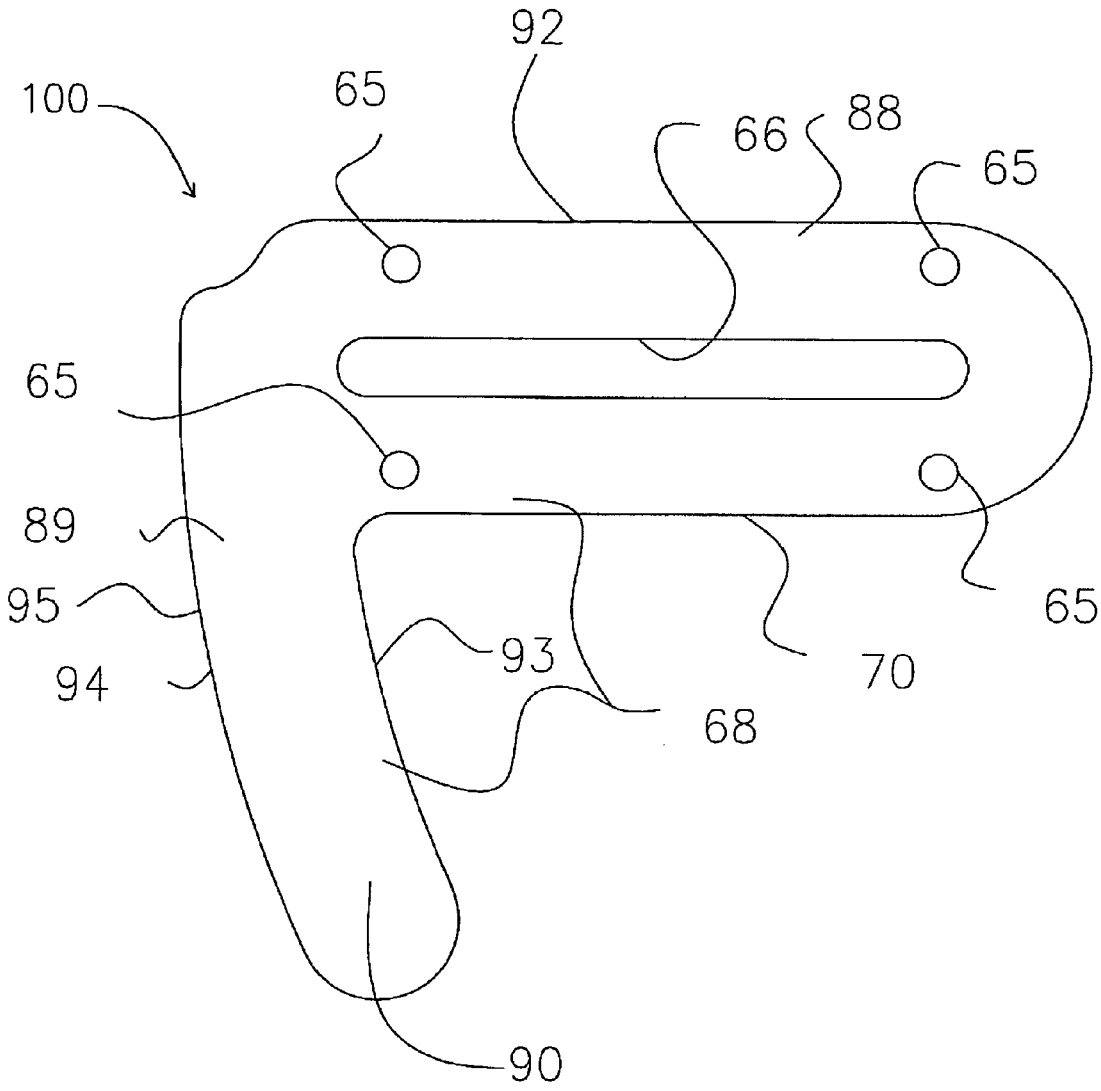
FIG. 14 is a bottom plan view thereof.
Figure 15:
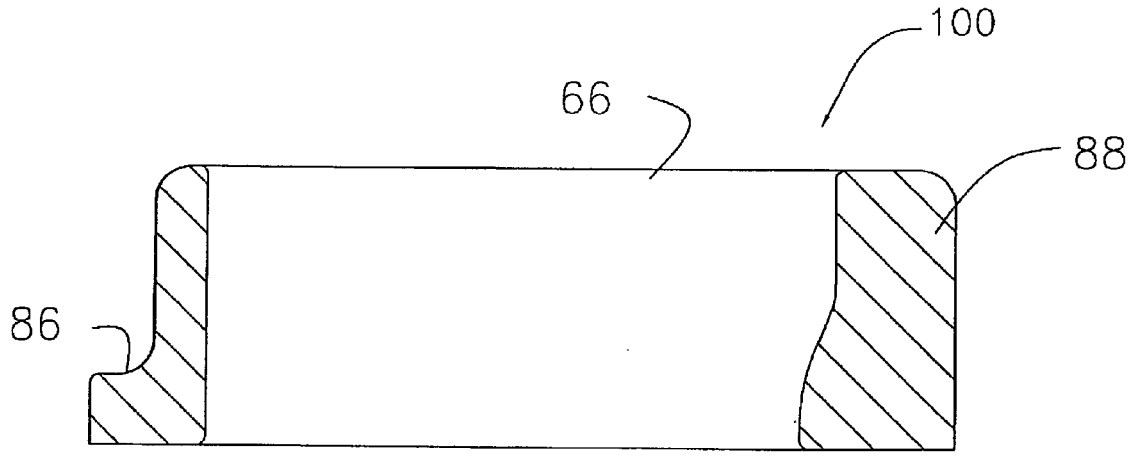
FIG. 15 is a cross-sectional view, taken along line 15-15 of FIG. 12.
Figure 16:
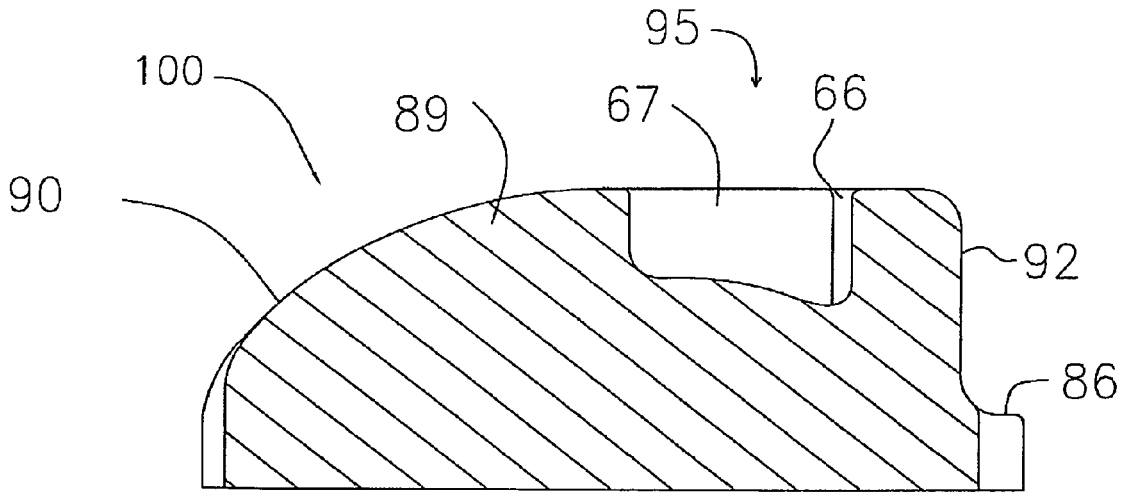
FIG. 16 is a cross-sectional view, taken along line 16-16 of FIG. 12.

As best seen in FIG. 11, the rotary cleaning head 1 may comprise a spindle 6, a spindle O-ring 16, a seal 8, a cover 7, six hollow spacers 39, a seal 14, a main vacuum disc 2, a sprayer 3, a sprayer O-ring 17, three vacuum heads 100, three glide shoes 5, six each of assembly screws 15 and 20; four mounting screws 18 for each of the vacuum heads 100; and one mounting screw 19 for each of the glide shoes 5. The spacers 39 may be molded as an integral part of the vacuum main disc 2, rather than being separate elements.

The spindle 6 may have a cleaning fluid bore 35, drive threads 36, and a flange 37 having six mounting holes 38. The spindle 6 and cover 7 may be made of any suitable strong, durable material, such as metal, plastic, or composites.

The cover 7 may have six mounting holes 40 and a vacuum opening 41 surrounded by a flange 42 for positioning and holding the seal 8 in its proper location on the upper side of the cover 7. The vacuum opening 41 may be of any suitable size, shape, and location as long as it does not unduly restrict the flow of air, used cleaning fluid, dirt and debris into the inlet 81 of the vacuum plenum 32. Alternatively, the flange 42 may be eliminated, and the seal 8 may be positioned and held in its proper location on the cover 7 in any other suitable way, such as by gluing it in place with any suitable adhesive, for example. The adhesive may be selected such that the seal 8 may be easily removed, such as if it is worn out and a new seal 8 is needed. As further alternatives, the lower side of the vacuum plenum 32 may carry the seal 8; or the seal 8 may be held in place by simply being sandwiched between the upper side of the cover 7 and the lower side of the vacuum plenum 32.

The seal 8 may be used to prevent a vacuum leak between the upper side of the cover 7 and the lower side of the vacuum plenum 32. The seal 8 may have any suitable size, shape, construction and location, as long as it does not unduly restrict the flow of air, etc. through the vacuum opening 41 in the cover 7 and the inlet 81 of the vacuum plenum 32 during use of the rotary cleaning head 1. The seal 8 may be made from any suitable material, such as an elastomer or felt. Alternatively, a separate seal 8 may be eliminated, and the desired seal between the upper side of the cover 7 and the lower side of the vacuum plenum 32 may be provided in any other suitable way, such as by providing matching smooth sealing surfaces on the upper side of the cover 7 and the lower side of the vacuum plenum 32.

Figure 9:
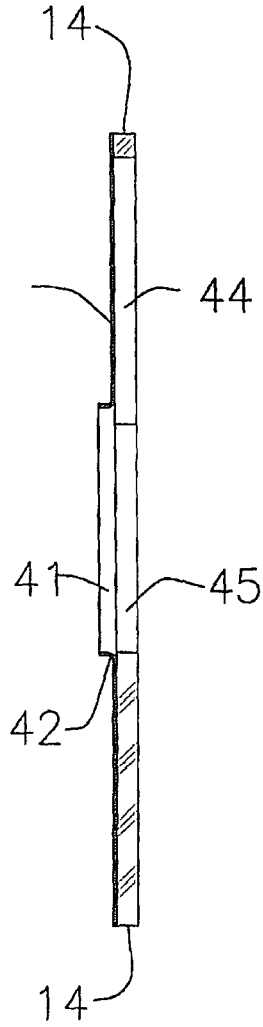
FIG. 9 is cross-sectional view taken along line 9-9 of FIG. 8.
Figure 10:
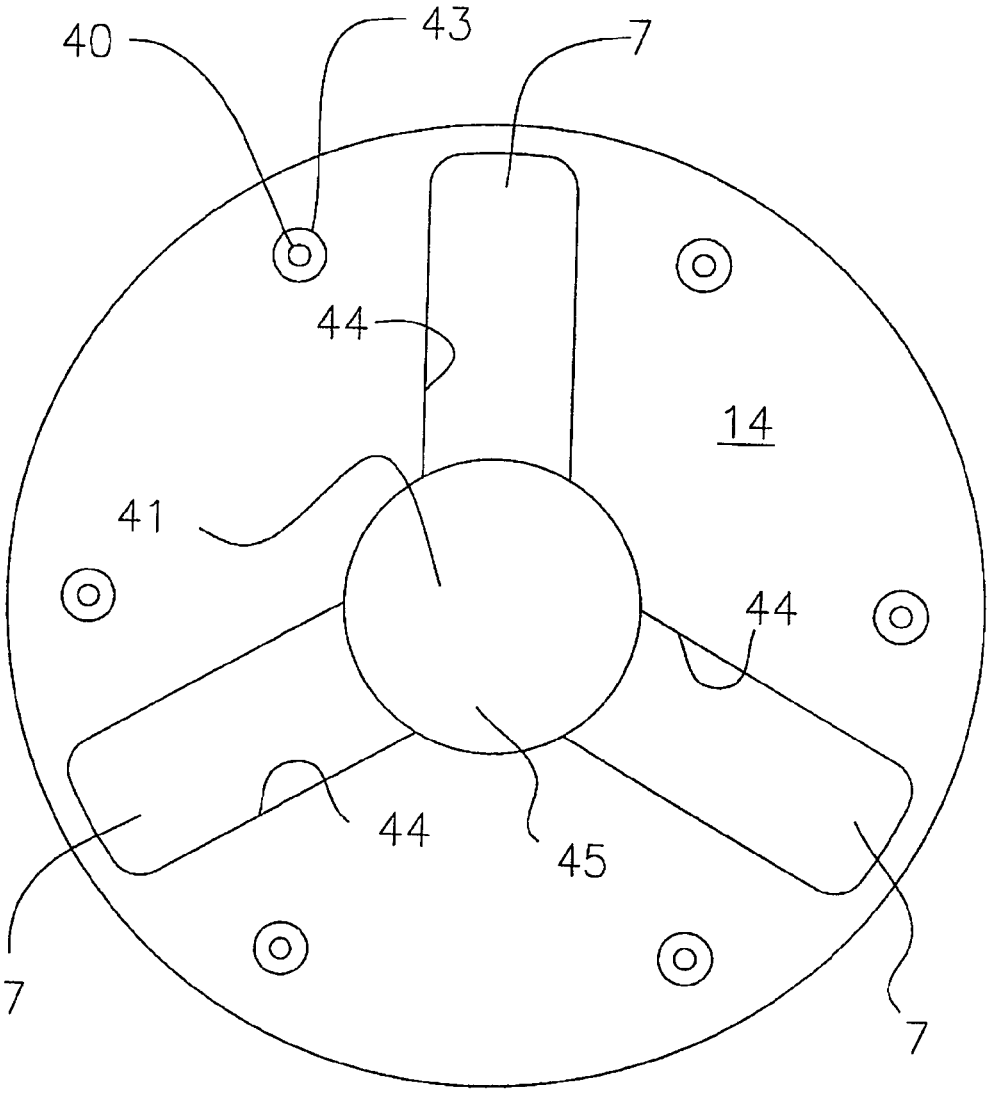
FIG. 10 is a bottom plan view of the cover 7 and seal 14.

As best seen in FIGS. 9-10, the seal 14 may have six spacer holes 43 that are sized to receive the six spacers 39; and may also have three vacuum channels 44 in communication with its vacuum distribution hub 45. The seal 14 may be made from any suitable material, such as an elastomer or felt. The seal may be positioned and held in its proper location between the cover 7 and the vacuum main disc 2 in any suitable way, such as by being sandwiched there between, or by being secured in any suitable way to the lower side of the cover 7 or to the upper side of the vacuum main disc 2, such as by the use of any suitable adhesive. The seal 14 may have a thickness that is selected so that it may extend from the upper side of the vacuum main disc 2 to the lower side of the cover 7

One function of the seal 14 may be to prevent an undesired vacuum leak between the cover 7 and the vacuum main disc 2. As perhaps best seen in FIGS. 4, 9 and 10, the outer peripheral portion of the seal 14 may serve this function. Alternatively, the desired seal between the cover 7 and vacuum main disc 2 may be provided in any other suitable way, such as by providing a separate O-ring or other seal between the cover 7 and vacuum main disc 2; in which case the outer peripheral portion of the seal 14 may be eliminated, as may be the spacers 39. As a further alternative, the cover 7 may be enlarged so that it extends over the raised rim 53 of the vacuum main disc 2, and any suitable seal may then be provided between the cover 7 and the rim 53; in which case the outer peripheral portion of the seal 14 may again be eliminated.

Another function of the seal 14 may be to define its vacuum channels 44 and its vacuum distribution hub 45, which may have any suitable respective size and shape. The respective vacuum channels 44 in the seal 14 and the vacuum channels 57 in the vacuum main disc 2 may be aligned with each other, to form respective composite vacuum channels 44, 57. The vacuum channels 57 may be of any suitable size and shape, and the respective vacuum channels 44, 57 may not be of the same size and shape. Similarly, the vacuum distribution hub 45 in the seal 14 may be aligned with the vacuum distribution hub 58 in the vacuum main disc 2, to form a composite vacuum distribution hub 45, 58. The vacuum distribution hub 58 may be of any suitable size and shape, and the respective vacuum distribution hubs 45, 58 may not be of the same size and shape. As an alternative to one seal 14 defining the vacuum distribution hub 45 and all of the vacuum channels 44, a separate seal that extends between the upper surface of the vacuum main disc 2 and the lower surface of the cover 7 may define the vacuum distribution hub 45 or any particular vacuum channel 44.

One of the functions of the vacuum channels 44, 57 may be to help channel the flow of air, etc., from the vacuum ports 59 in the vacuum main disc 2 to the vacuum distribution hubs 45, 58. Another function of the vacuum channels 44, 57 may be to help guide the flow of air, used cleaning fluid, dirt and debris through the rotary cleaning head in a way the reduces, if not eliminates, any areas within the rotary cleaning head 1 that might otherwise tend to trap some of the used cleaning fluid, dirt and debris. One of the functions of the vacuum distribution hubs 45, 58 may be to help channel the flow of air, etc., from the vacuum channels 44, 57 to the vacuum opening 41 in the cover 7.

One vacuum channel 44, 57 may be provided for each vacuum port 59 in the vacuum main disc 2. As an alternative, one or more of the vacuum channels 44 may be enlarged so that it merges together with an adjacent vacuum channel 44, in which case the corresponding portions of the seal 14 that would have been located between the merged vacuum channels 44 may be eliminated. As a further alternative, all portions of the seal 14 located between the vacuum channels 44 may be eliminated, resulting in one large vacuum channel 44 for all of the vacuum ports 59 in the vacuum main disc 2.

As a further alternative, one or more of the vacuum channels 44 in the seal 14 may be eliminated, in which case the seal 14 may extend into the areas that would have been occupied by the eliminated vacuum channels 44. This may be done, for example, if the corresponding vacuum channels 57 in the vacuum main disc 2 are enlarged in any suitable way so that they can perform the functions of the eliminated vacuum channels 44 in the seal 14.

If all of the vacuum channels 44 in the seal 14 are eliminated in the manner just described, then the entire seal 14 may be eliminated, and a seal between the cover 7 and the vacuum main disc 2 may be provided in any other suitable way, such as those that have been described above. There may, or may not, be a space provided between all or part of the cover 7 and the vacuum main disc 2 in this situation.

As a further alternative, the seal 14's vacuum distribution hub 45 may be eliminated, such as by eliminating the seal 14. This may be done if the corresponding vacuum distribution hub 58 in the vacuum main disc 2 is enlarged in any suitable way so that it can perform the functions of the eliminated vacuum distribution hub 45 in the seal 14. Here again, a seal between the cover 7 and the vacuum main disc 2 may be provided in any other suitable way, such as those that have been described above. There may, or may not, be a space provided between all or part of the cover 7 and the vacuum main disc 2 in this situation.

Figure 6:
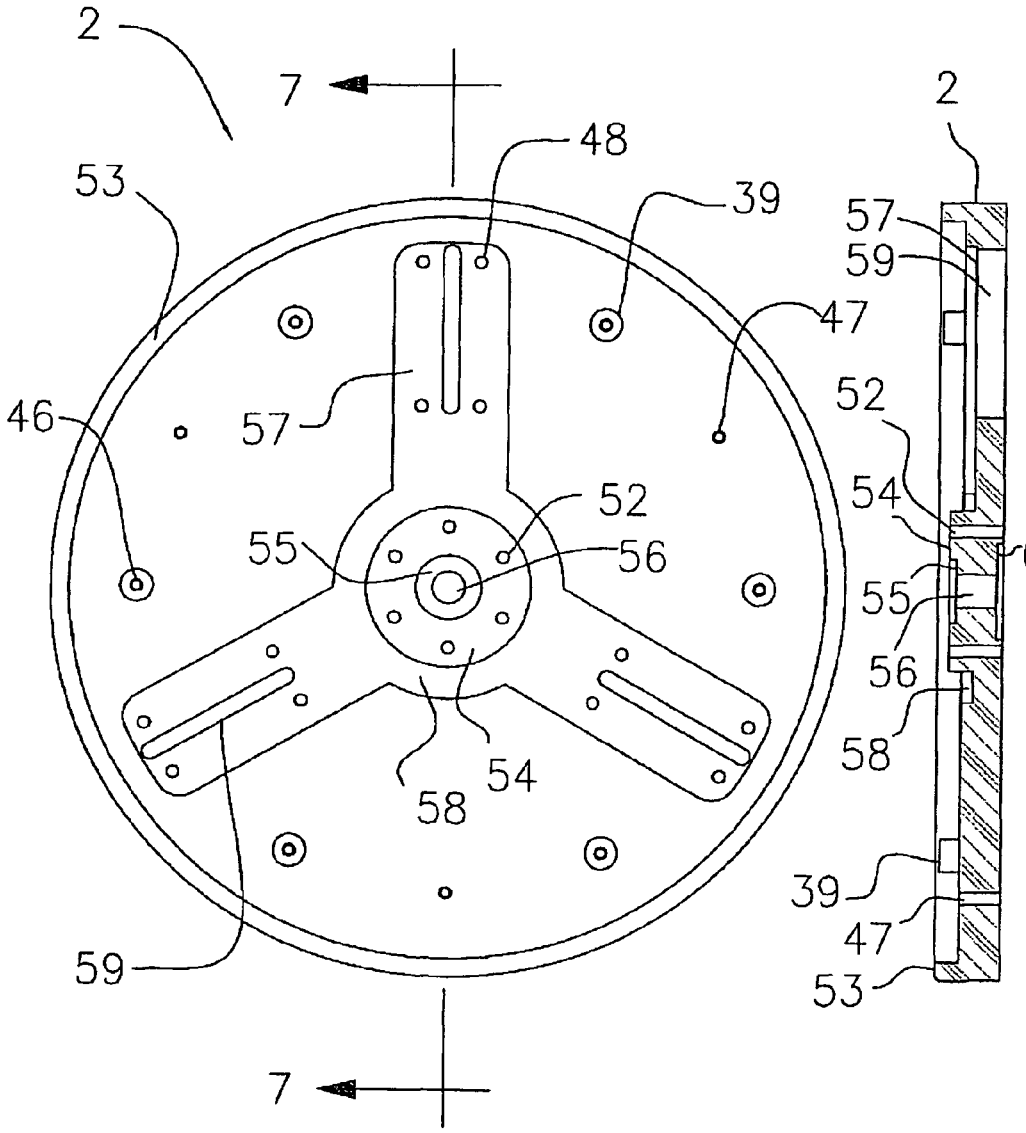
FIG. 6 is a top plan view of a vacuum main disc 2 that may be used in the rotary cleaning head 1.
Figure 7:
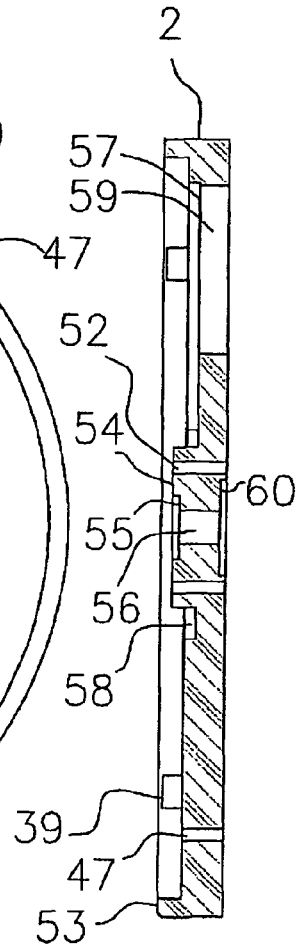
FIG. 7 is a cross-sectional view taken along line 7-7 of FIG. 6.
Figure 8:
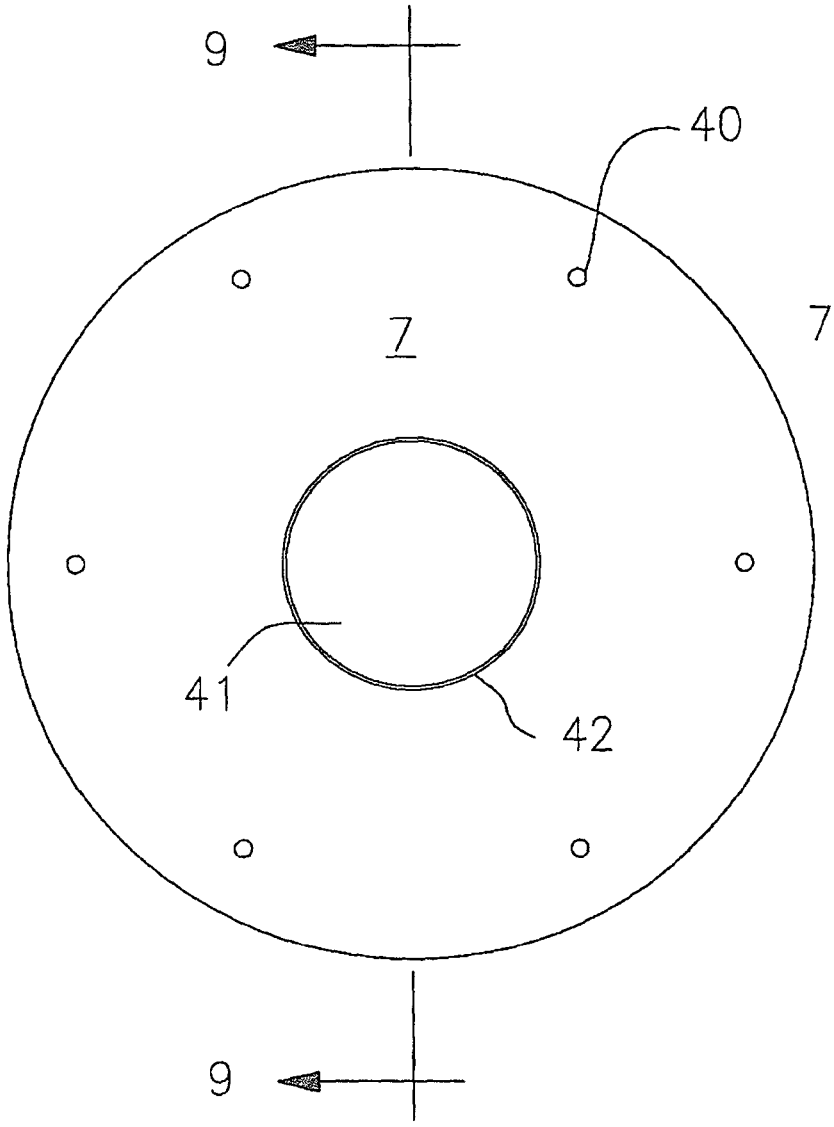
FIG. 8 is top plan view of a cover 7 that may be used in the rotary cleaning head 1.

As best seen in FIGS. 4, 6, and 11, the vacuum main disc 2 may have six threaded mounting holes 46 for cover 7, each surrounded by a spacer 39; three threaded mounting holes 47, one for each of the glide shoes 5; twelve mounting holes 48 for vacuum heads 100, four for each of the vacuum heads 100; and six mounting holes 52 for the spindle 6 and sprayer 3. The vacuum main disc 2 may be made from any suitable strong, durable material, such as metal, plastic or composites; and may be made as one piece in any suitable way, such as by injection molding it from plastic.

The upper side of the vacuum main disc 2 may have a raised peripheral rim 53; a raised central boss 54 having a circular recess 55 for O-ring 16, and a fluid bore 56 for the cleaning fluid; three recessed vacuum channels 57 communicating with a recessed vacuum distribution hub 58; and three vacuum ports 59 in the vacuum channels 57 for the three vacuum heads 100. The lower side of the vacuum main disc 2 may have a circular recess 60 for O-ring 17.

The functions of the raised peripheral rim 53 may include helping to properly position and protect the cover 7 and seal 14. Alternatively, the rim 53 may be eliminated, such as if the seal 14 were eliminated, so that the cover 7 may rest close to, or on, the upper surface of the vacuum main disc 2.

As seen in FIGS. 6 and 11, one vacuum channel 57 may be provided for each of the vacuum ports 59. As an alternative, one or more of the vacuum channels 57 may be enlarged so that it merges together with an adjacent vacuum channel 57 to form an enlarged composite vacuum channel 57. As a further alternative, all of the vacuum channels 57 may be enlarged and merged, to form one large composite vacuum channel 57 for all of the vacuum ports 59.

As another alternative, one or more of the vacuum channels 57 in the vacuum main disc 2 may be eliminated. This may be done, for example, if the corresponding vacuum channels 44 in the seal 14 are enlarged in any suitable way so that they can perform the functions of the eliminated vacuum channels 57.

Figure 2:
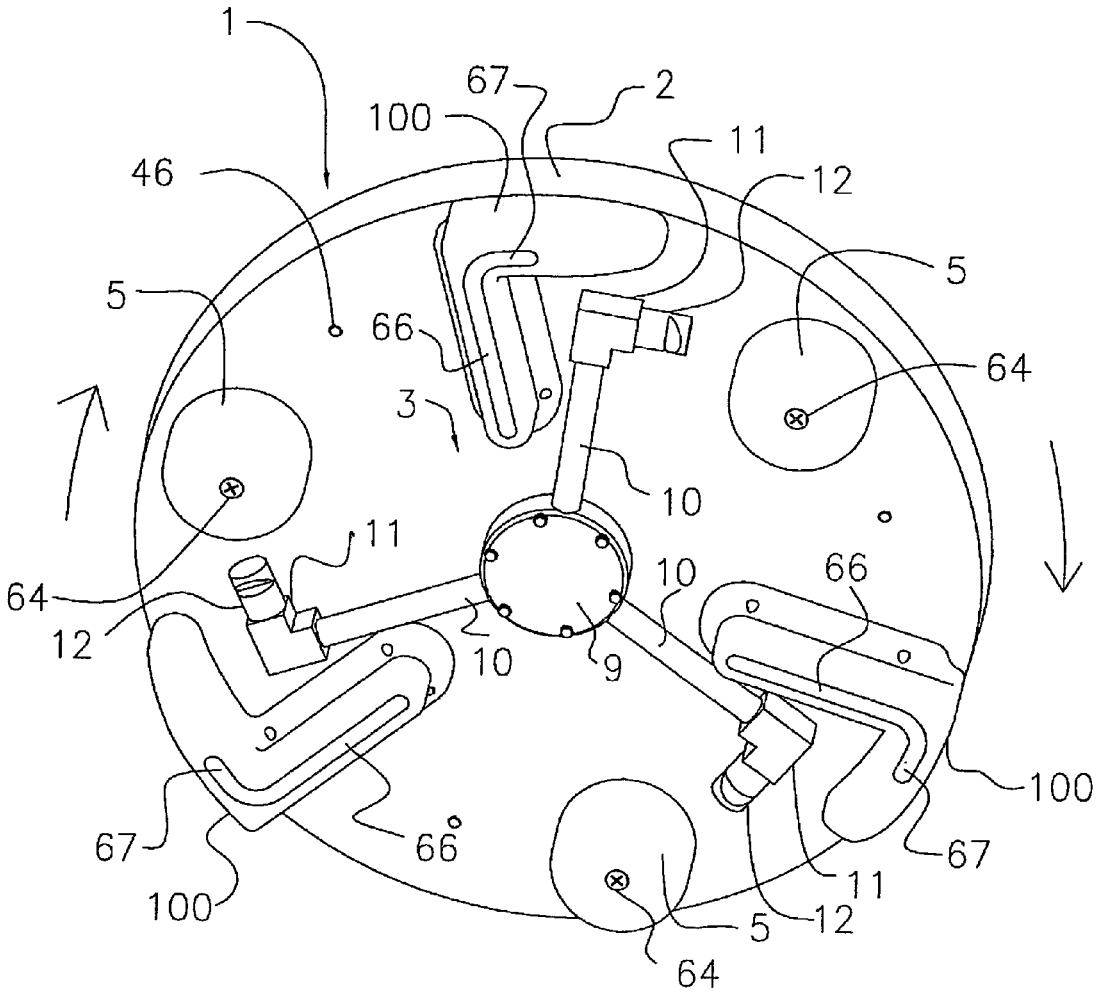
FIG. 2 is a perspective view showing the lower side of the floor cleaning machine 13's rotary cleaning head 1.
Figure 3:
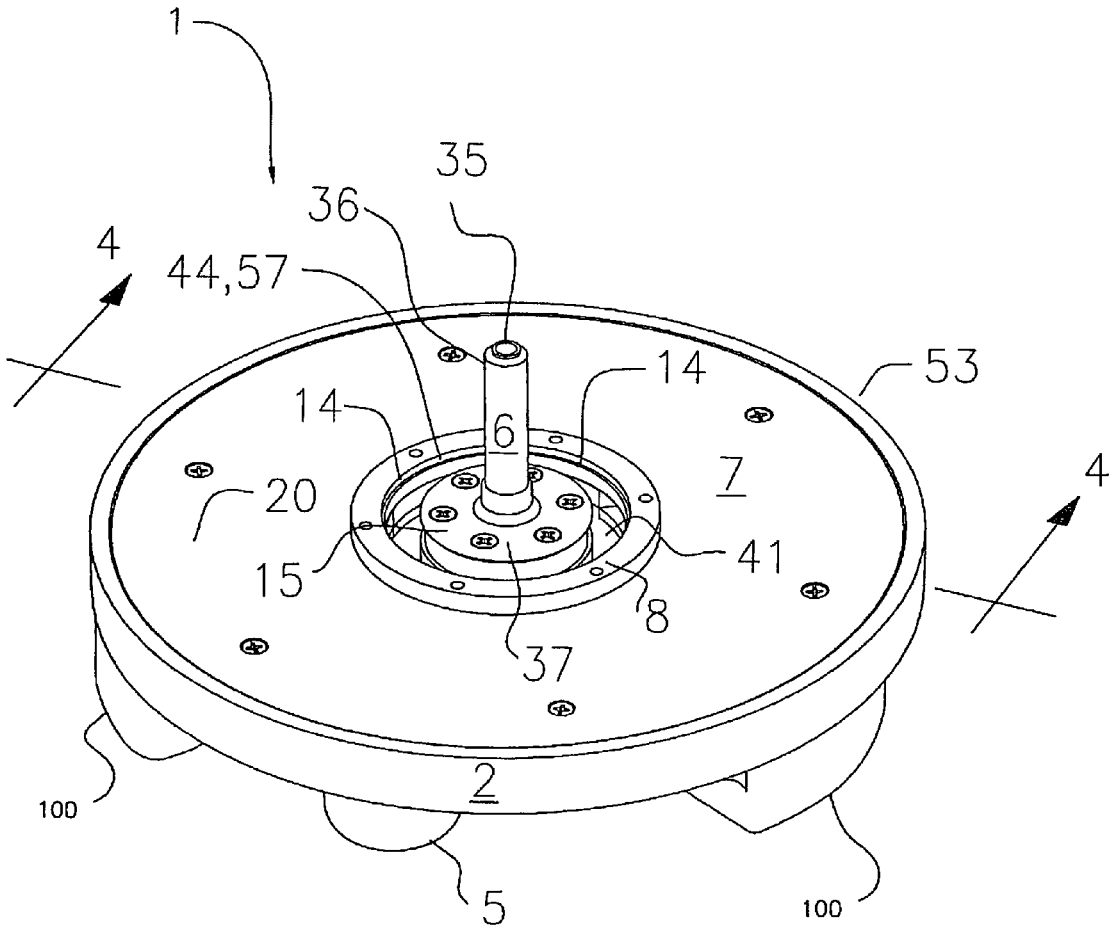
FIG. 3 is perspective view showing the upper side of the rotary cleaning head 1.
Figure 5:
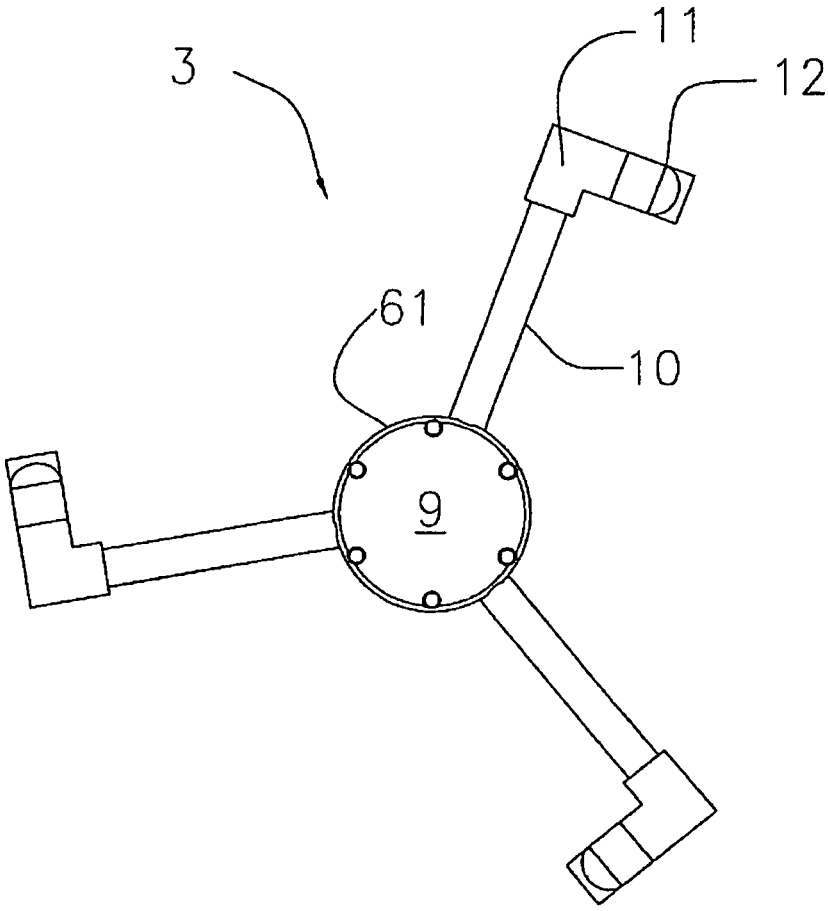
FIG. 5 is a bottom plan view of a sprayer 3 that may be used in the rotary cleaning head 1.

As best seen in FIGS. 2, 5, and 11, the sprayer 3 may have a hollow hub 9 having six threaded mounting holes 61 and a central port 62 in its upper side; and three hollow spray arms 10, each terminating in a hollow elbow 11 and a spray nozzle 12. One of the functions of the sprayer 3 may be to deliver, in any suitable way, sprays of cleaning fluid to the surface being cleaned. The sprayer 3 may be of any suitable size, shape, construction and location; and may be made from any suitable strong, durable material such as metal, plastic or composites. The sprayer 3 may have any desired number of spray arms 10, with their associated elbows 11 and spray nozzles 12. As an alternative, the elbows 11 may be eliminated and replaced by a bent portion of the spray arms 10.

As best seen in FIGS. 2 and 11, each glide shoe 5 may have a mounting bore 63 for its mounting screw 19, and the lower end 64 of its mounting bore 63 may be enlarged, so that the head of its mounting screw 19 may be recessed below its lower surface. The glide shoes 5 may be of any suitable size, shape, construction and location; and may be made from any suitable strong, durable material such as metal, plastic or composites. The glide shoes 5 may have a vertical thickness that is selected to be about the same as that of the vacuum heads 100. One function of the glide shoes 5 may be to help support the vacuum main disc 2. There may be any desired number of the glide shoes 5. Alternatively, the glide shoes 5 may be eliminated.

As best seen in FIGS. 1-4 and 11-16, the rotary cleaning head 1's vacuum main disc 2 may carry the vacuum heads 100. A vacuum head 100 may be generally L-shaped and have a mounting surface 68; an exterior surface 69; a mounting flange 86; a vacuum port arm 88 that may define a vacuum port 66; and a vacuum slot arm 89 that may define a vacuum slot 67. As an alternative to any particular vacuum head 100 being a separate element that is secured to the vacuum main disc 2, it may instead be integrally formed as part of the vacuum main disc 2. One or more of the vacuum heads 100 may not be the same as one or more of the other vacuum heads 100.

The L-shaped configuration of a vacuum head 100 may offer the advantage of minimizing the size, cost, and amount of materials needed to make the vacuum head 100. This is because an L-shaped vacuum head 100 may be made so that it is just large enough to define the desired size and shape of its vacuum port 66 and vacuum slot 67, while still being strong and durable enough to do its job. However, as an alternative, a vacuum head 100 may have any other suitable desired size and shape other than being L-shaped.

All or part of a vacuum head 100's mounting surface 68 may be shaped to conform to the shape of the corresponding portion of the vacuum main disc 2 to which the vacuum head 100 may be mounted, to help provide a vacuum seal between the vacuum head 100 and the vacuum main disc 2. Alternatively, all or part of its mounting surface 68 may not conform to the shape of the corresponding portion of the vacuum main disc 2 to which it is mounted, in which case the desired vacuum seal between the vacuum head 100 and the vacuum main disc 2 may be provided in any suitable way, such as by providing any suitable gasket therebetween.

A vacuum head 100 may be mounted to the vacuum main disc 2 so that its vacuum port 66 is at least partially aligned with a respective vacuum port 59 in the vacuum main disc 2, to enable its vacuum port 66 to be operable to receive a vacuum from its respective vacuum port 59. A vacuum head 100 may be mounted to the vacuum main disc 2 in any suitable way, such as by using four mounting screws 18 which pass through the vacuum main disc 2 and engage corresponding threaded mounting bores 65 in the vacuum head 100's mounting flange 86. One or more of the vacuum heads 100 may not be mounted to the rotary cleaning head 1 in the same way as one or more of the other vacuum heads 100.

During use of the rotary cleaning head 1, portions of the exterior surface 69 of its vacuum heads 100 may be in contact with the surface being cleaned, and may at least partially support the rotary cleaning head 1.

A vacuum head 100's vacuum port arm 88 and vacuum port 66 may have any suitable desired size and shape. As illustrated in the Figures, a vacuum port arm 88 and its vacuum port 66 may be elongated, narrow, and straight. Alternatively, a vacuum port arm 88 and its vacuum port 66 may have any other desired size and shape, and need not be straight along part or all of their respective lengths. The vacuum port arm 88 and vacuum port 66 of one or more of the vacuum heads 100 may not be the same as the vacuum port arm 88 and vacuum port 66 of one or more of the other vacuum heads 100.

A vacuum head 100's vacuum port arm 88 and vacuum port 66 may be oriented so that they extend at least generally radially outwardly from the axis of rotation of the rotary cleaning head 1, and may have a respective effective radial length that is any part, or all, of the distance from the rotary cleaning head 1's axis of rotation to its periphery.

For a vacuum head 100 of any given size, such a radial orientation of its vacuum port arm 88 and vacuum port 66 may offer the advantage of maximizing the effective radial length of its vacuum port 66. This may, in turn, may maximize the area of the floor its vacuum port 66 can vacuum during each rotation of the rotary cleaning head 1, while minimizing the overall size and cost of a vacuum head 100. Alternatively, a vacuum head 100's vacuum port arm 88 and vacuum port 66 may be oriented at any desired angle with respect to a radius of the rotary cleaning head 1, from about zero degrees to about plus or minus ninety degrees. Similarly, a vacuum head 100 may also have any suitable desired radial length, and orientation with respect to a radius of the rotary cleaning head 1.

The angle that a vacuum head 100's vacuum port 66 makes with respect to a radius of the rotary cleaning head 1 may be adjusted by either orienting the vacuum port 66 at the desired angle within its vacuum head 100, or by orienting the vacuum head 100 at the desired angle with respect to a radius of the rotary cleaning head 1.

A vacuum head 100's vacuum slot arm 89 and vacuum slot 67 may have any suitable desired size and shape; and may extend any part, or all, of the way to the adjacent vacuum head 100, or may extend any part, or all, of the way to some other structure on the bottom of the vacuum main head 2, such as to one of its glide shoes 5.

As illustrated in the Figures, a vacuum head 100's vacuum slot arm 89 and vacuum slot 67 may be elongated, narrow, and slightly arcuate in configuration. Alternatively, its vacuum slot arm 89 and vacuum slot 67 may have any other desired size and shape, and need not be slightly arcuate along part or all of their respective lengths. The vacuum slot arm 89 and vacuum slot 67 of one or more of the vacuum heads 100 may not be the same as the vacuum slot arm 89 and vacuum slot 67 of one or more of the other vacuum heads 100.

A vacuum head 100's vacuum slot arm 89 and vacuum slot 67 may be oriented at least generally perpendicularly with respect to a radius of the rotary cleaning head 1; may extend forward from the vacuum head 100's vacuum port arm 88 and vacuum port 66 in the direction of rotation of the rotary cleaning head 1 any desired distance. Alternatively, a vacuum head 100's vacuum slot arm 89 and vacuum slot 67 may be oriented at any other desired angle with respect to a radius of the rotary cleaning head 1, from about zero degrees to about one hundred and eighty degrees. Similarly, a vacuum head 100 may also have any desired length with respect to a radius of the rotary cleaning head 1, and any desired orientation with respect to a radius of the rotary cleaning head 1.

If a vacuum head 100 is mounted adjacent to the periphery of a rotary cleaning head 1, then its vacuum slot arm 89 and vacuum slot 67 may have an arcuate configuration that at least partially conforms to the corresponding shape of the adjacent portion of the periphery of the rotary cleaning head 1, so that its vacuum slot arm 89 and vacuum slot 67 do not stick out past the periphery of the rotary cleaning head 1, where they might be damaged, or might cause damage to an object in the room being cleaned.

Alternatively, a vacuum head 100's vacuum slot arm 89 and vacuum slot 67 may not have an arcuate configuration; may be located partially, or entirely, within the periphery of the rotary cleaning head 1; or may be located partially, or entirely, outside of the periphery of the rotary cleaning head 1.

As seen in the Figures, a vacuum head 100's vacuum port 66 and vacuum slot 67 may blend together where they intersect, since its vacuum port 66 is operable to provide a vacuum to its vacuum slot 67. As a result, its vacuum port arm 88 may define part of its vacuum slot 67, and its vacuum slot arm 89 may define part of its vacuum port 66. Similarly, part of its vacuum port 66 may be part of its vacuum slot 67, and part of its vacuum slot 67 may be part of its vacuum port 66.

The leading side 70 of a vacuum head 100's vacuum port arm 88 may have a tapered or rounded shoulder 87. Similarly, the leading end portion 90 of a vacuum head 100's vacuum slot arm 89 may be tapered or rounded, and the vacuum slot arm 89 may have tapered or rounded shoulders 91. The vacuum port arm 88's leading side 70 is its side that faces in the direction of rotation of the rotary cleaning head 1, and vacuum slot arm 89's leading end portion 90 is its end portion that faces in the direction of rotation of the rotary cleaning head 1.

A vacuum head 100's tapered or rounded shoulders 87, 91 and tapered or rounded leading end portion 90 may help it to ski up and over any stationary objects it might encounter during use, rather than simply impacting on them; in order minimize any damage such an impact might otherwise cause to the vacuum head 100 or to the stationary objects. The tapered or rounded shoulders 87, 91 and the tapered or rounded leading end portion 90 may also help to prevent the vacuum head 100 from snagging on soft surfaces, such as carpeting, or scratching hard surfaces.

During operation of the cleaning machine 13, the vacuum main disc 2, sprayer 3, and vacuum heads 100 of its rotary cleaning head 1 may all rotate about the rotary cleaning head 1's axis of rotation. Such rotation may help enable the sprayer 3 to efficiently distribute cleaning fluid over the floor surface being cleaned, and may help the vacuum heads 100 to efficiently vacuum up the waste cleaning fluid from the floor surface being cleaned.

Prior art floor cleaning machines which have a rotary cleaning head to which vacuum heads are attached may have the problem of the vacuum heads tending to sling cleaning fluid radially outwardly away from the floor cleaning machine, since the centrifugal force generated by the rotating vacuum heads causes some of the cleaning fluid to first travel radially outwardly along the leading sides of the vacuum heads, and to then be slung radially outwardly away from the vacuum heads. As a result, such prior art floor cleaning machines may either be messy to use because they sling cleaning fluid into the room being cleaned, or may require relatively complex and costly shrouds to prevent the slung cleaning fluid from traveling out into the room being cleaned.

This problem may be at least partially solved by a vacuum head 100's vacuum slot arm 89 and vacuum slot 67 which may, as has been described, extend forward from the vacuum head 100's vacuum port arm 88 in the direction of rotation of the rotary cleaning head 1. As a result, any cleaning fluid that migrates across the lower surface of the vacuum main disc 2 to the leading side 70 of the vacuum port arm 88, or that lands on the leading side 70, may then travel radially outwardly along the leading side 70 and across the radially inner side 93 of the vacuum slot arm 89, to then be vacuumed up by the vacuum slot 67, rather than that cleaning fluid being slung radially outwardly from the vacuum head 100, and creating a mess that may be time consuming and expensive to clean up.

Similarly, any cleaning fluid that migrates across the lower surface of the vacuum main disc 2 to the radially inner side 93 of the vacuum slot arm 89, or that lands on the radially inner side 93, may then travel radially outwardly across the radially inner side 93 to then be vacuumed up by the vacuum slot 67 in the vacuum slot arm 89, rather than that cleaning fluid being slung radially outwardly from the vacuum head 100, and creating a mess that may be time consuming and expensive to clean up.

In addition, the vacuum slot 67 in a vacuum head 100's vacuum slot arm 89 and the vacuum port 66 in its vacuum port arm 88 may also vacuum up cleaning fluid directly from the floor being cleaned.

In any event, the cleaning fluid that enters a vacuum head 100's vacuum slot 67 then travels within its vacuum slot 67 to its vacuum port 66. Cleaning fluid from the vacuum port 66 then passes sequentially through the rotary cleaning head 1's corresponding vacuum port 57, vacuum channels 44, 57 and vacuum distribution hub 45, 58; through the vacuum opening 41 in the cover 7; through the inlet 81 of the vacuum plenum 32; through the vacuum plenum 32; and then exits the cleaning machine 13 through its vacuum coupling 33.

To aid in the vacuuming up of the cleaning fluid by a vacuum head 100's vacuum port 66 and vacuum slot 67 part, or all, of the leading side 70 of its vacuum port arm 88 may be shorter in height than its trailing side 92; and part, or all, of the radially inner side 93 of its vacuum slot arm 89 may be shorter in height than the radially outer side 94 of its vacuum slot arm 89.

If a vacuum head 100's vacuum slot arm 89 has a configuration in which its leading end portion 90 is radially closer to the rotary cleaning head 1's axis of rotation than is its trailing end 95, then this may aid in the ability of the vacuum head 100 to collect and vacuum up cleaning fluid from the floor being cleaned. This is because with such a configuration centrifugal force will tend to cause cleaning fluid on the vacuum slot arm 89 to migrate radially outwardly along the vacuum slot arm 89 towards the trailing end 95 of its vacuum slot 67, where it may then be more readily vacuumed up by its vacuum slot 67.

The Figures depicting the vacuum heads 4, 100 are to scale. By way of example, for a rotary cleaning head 1 having a diameter of about twelve inches, a vacuum head 100's vacuum port arm 88 may have an overall length of about 3.75 inches, its vacuum port 66 may have an overall length of about 3.0 inches, its vacuum slot arm 89 may have an overall length of about 3.0 inches, and its vacuum slot 67 may have an overall length of about 1.0 inches.

The ratio of the length of the vacuum port 66 to the length of the radius of the rotary cleaning head 1 may be in the range of about 1:3 to about 1:1. The ratio of the length of the vacuum slot 67 to the circumference of the rotary cleaning head 1 be in the range of about 1:4 to about 1:1.

In view of all of the disclosures herein it will now be apparent to a person of ordinary skill in the art how to modify the vacuum heads 100 and the rotary cleaning head of any floor cleaning machine, as needed, in order to enable the vacuum heads 100 to function with any floor cleaning machine 13 having a rotary cleaning head, even though its rotary cleaning head may be quite different in construction and operation from the rotary cleaning head 1 that has been described and illustrated herein.

For example, the rotary cleaning head 1 that is illustrated and described herein comprises a main disc 2 of a specific construction that carries the vacuum heads 100 and provides them with a vacuum. However, it is apparent that the rotary cleaning head 1 and main disc 2 may be of a wide variety of different constructions and still be operable to carry the vacuum heads 100 and provide them with a vacuum, if the rotary cleaning head 1, main disc 2, and vacuum heads 100 are suitably modified, as needed.

By way of further example, many conventional "octopus" floor cleaning machines have an "octopus" rotary cleaning head comprising several arms which carry its vacuum heads and provides them with a vacuum. For example, U.S. Pat. No. 4,333,204 (which is hereby incorporated into this specification by reference), discloses an "octopus" floor cleaning machine 10 having an "octopus" rotary cleaning head comprising three vacuum arms 42, with each arm having an elongated vacuum slot 44. Each vacuum arm 42 and its vacuum slot 44 functions as a kind of vacuum head 100

In view of the disclosures herein, it will now be apparent to a person of ordinary skill in the art how to modify the vacuum heads 100 and the "octopus" rotary cleaning head of any "octopus" floor cleaning machine, as needed, in order to enable the vacuum heads 100 to function with the "octopus" rotary cleaning head of any "octopus" rotary floor cleaning machine.

Figure 17:
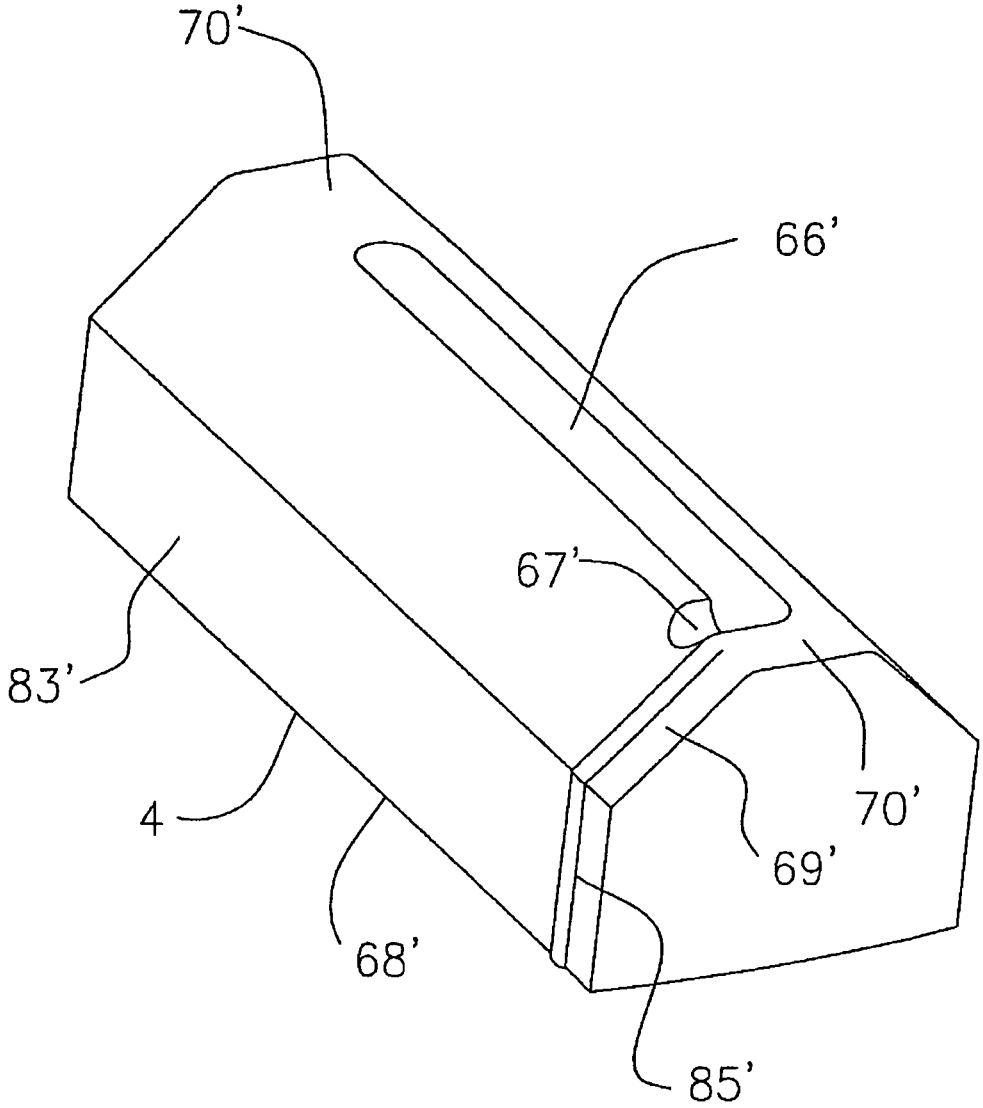
FIG. 17 is a perspective view showing the bottom of a vacuum head 4 that may be used in the rotary cleaning head 1.
Figure 18:
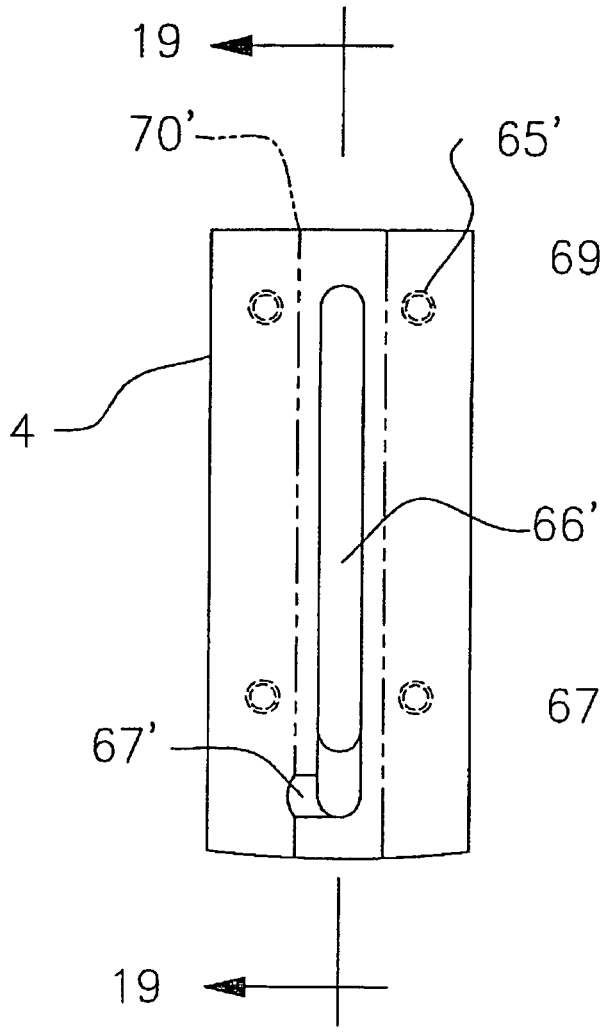
FIG. 18 is a bottom plan view of the vacuum head 4.
Figure 19:
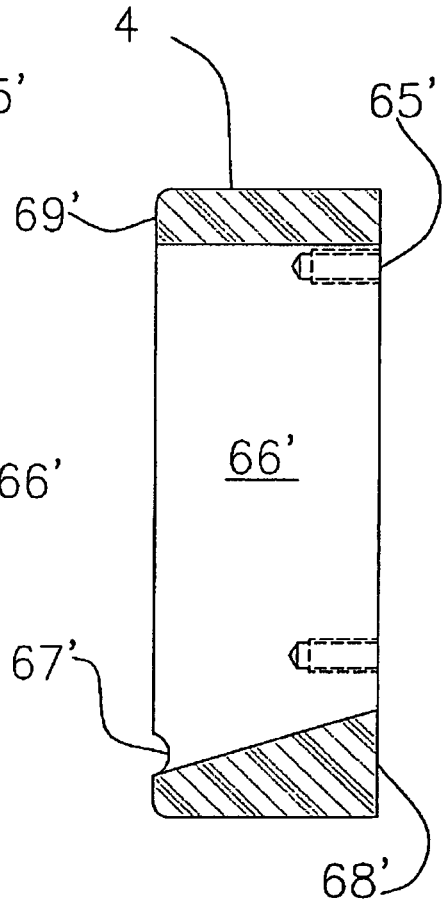
FIG. 19 is a cross-sectional view of the vacuum head 4, taken along line 19-19 of FIG. 18.

Turning now to FIGS. 17-19, an alternative vacuum head 4 is illustrated. The vacuum head 4 of FIGS. 17-19 is the same as, or at least similar to, the vacuum head 100 of FIGS. 1-4 and 11-16 in all respects, except for those differences that will be made apparent by all of the disclosures herein. In addition, for clarity and simplicity, certain parts of the vacuum head 4 of FIGS. 17-19 have been given the same reference numerals, with a prime appended thereto, as the reference numerals used for the corresponding respective parts of the vacuum head 100 of FIGS. 1-4 and 11-16.

Each vacuum head 4 may have four threaded mounting bores 65' for its mounting screws 18, a vacuum port 66', and a vacuum slot 67'. A vacuum head 4 may be of any suitable size, shape, construction and location; may be made from any suitable strong, durable material such as metal, plastic or composites. All of the vacuum heads 4 may not be the same in their respective sizes, shapes, constructions and locations.

The lower side 69' of a vacuum head 4 may taper in width to a relatively narrow support surface 70' that may have chamfered shoulders, in order to help prevent the edges of the support surface 70' from snagging on soft surfaces, such as carpeting, or from scratching hard surfaces. During use of the rotary cleaning head 1, the support surface 70' may be in contact with the surface being cleaned, and may at least partially support the rotary cleaning head 1. Alternatively, there may be less, or no, taper in the lower side 69' of a vacuum head 4, so that the support surface 70' may have a maximum width that is the same as that of the lower side 69' of a vacuum head 4.

One function of the vacuum port 66' in a vacuum head 4 may be to convey air, etc., from the surface being cleaned to the corresponding vacuum port 59 in the main disc 2. A vacuum port 66' may increase in length from the upper side 68' of a vacuum head 4 to its lower side 69'. This increase in length permits the vacuum port 66' to reach closer to the periphery of the main disc 2 than would otherwise be the case, for better vacuuming action. Alternatively, the length of a vacuum port 66' may be uniform between a vacuum head 4's upper and lower sides 68', 69'. The vacuum ports 66' of the various vacuum heads 4 may be of any suitable size, shape, construction and location; and all of the vacuum ports 66' may not be the same in size, shape, construction and location. As an alternative, there may be more than one vacuum port 66' in any particular vacuum head 4.

The vacuum slot 67' of a vacuum head 4 may serve the function of routing into the vacuum port 66' at least some of the cleaning fluid being slung outwardly by centrifugal force along the outer surfaces 83', 69' of a vacuum head 4. Thus, a vacuum slot 67' may help to prevent the undesirable spraying of the cleaning fluid out from the rotary cleaning head 2, where it might damage walls or furnishings, for example. A vacuum slot 67' may be oriented so that it extends in a direction towards the adjacent spray nozzle 12, and facing the direction of rotation of the rotary cleaning head 1. This is because the side 83' of a vacuum head 4 that is closest to the adjacent spray nozzle 12, and that is closest to the direction of rotation of the rotary cleaning head 1, will tend to be the wettest.

A vacuum slot 67' may be of any suitable size, shape, construction and location. For example, rather than a vacuum slot 67' being located only in the support surface 70' of a vacuum head 4, as an alternative it may extend part, or all, of the way across the lower side 69' of a vacuum head 4, and it may extend part, or all, of the way down the side 83' of a vacuum head 4. The functions of an elongated vacuum slot 67' may include helping to collect and direct water, etc. into the portion of the vacuum slot 67' that lies in the support surface 70'. As further alternatives, there may be more than one vacuum slot 67' in any particular vacuum head 4, or the vacuum slot 67' in any particular vacuum head 4 may be eliminated. The vacuum slots 67' of the various vacuum heads 4 may not be the same in their respective sizes, shapes, constructions and locations.

As another alternative, any particular vacuum head 4 may include a ridge 85' that may extend part, or all, of the way across the lower side 69' of a vacuum head 4, and that may extend part, or all, of the way down the side 83' of a vacuum head 4. The radially inward surfaces of a ridge 85' may be flat and vertical with respect to the respective surfaces 69', 83' of a vacuum head 4, or may be flat and inclined at an acute angle with respect to the respective surfaces 68', 83', to aid in the ability of a ridge 85' to serve its functions. The functions of a ridge 85' may include helping to collect and direct water, etc. into the vacuum slot 67' on a vacuum head 4. The ridges 85' of the various vacuum heads 4 may not be the same in their respective sizes, shapes, constructions and locations. Both a ridge 85' and an elongated vacuum slot 67' may be used on any particular vacuum head 4.

Although three vacuum heads 4 are illustrated, as an alternative there may be one, two, three, or more vacuum heads 4. Regardless of the number of vacuum heads 4, the rotary cleaning head 1 may have for each vacuum head 4 a respective vacuum port 59, vacuum channels 44, 57; and vacuum distribution hubs 45, 58. Similarly, each vacuum head 4 may have an associated spray arm 10, elbow 11 and nozzle 12 located near to it.

In order to assemble the rotary cleaning head 1, the spindle O-ring 16 and the sprayer O-ring 17 may be placed in their respective recesses 55, 60 in the vacuum main disc 2. The assembly screws 15 may then be used to assemble the spindle 6 and the spindle O-ring 16 to the upper surface of the vacuum main disc 2's central boss 54, and to assemble the sprayer 3 and the sprayer O-ring 17 to the bottom of the vacuum main disc 2, by placing the assembly screws 15 sequentially through the holes 38 in the spindle flange 37 and the holes 52 in the central boss 54; and by then threading them into the threaded holes 61 in the hub 9 of the sprayer 3.

The assembly screws 20 may be used to assemble the cover 7, the seal 14 and the hollow spacers 39 to the upper surface of the vacuum main disc 2 by placing the assembly screws 20 sequentially through the holes 40 in the cover 7 and the holes in the hollow spacers 39; and by then threading them into the threaded holes 46 in the vacuum main disc 2.

The mounting screws 19 may be used to mount the glide shoes 5 to the lower surface of the vacuum main disc 2 by passing them through the mounting bores 63 in the glide shoes 5, and by then screwing them into the threaded mounting holes 47 in the lower side of the vacuum main disc 2.

Referring now to FIGS. 1 and 4, the rotary cleaning head 1 may then be mounted to the cleaning machine 13 by screwing the drive threads 36 on the spindle 6 into corresponding drive threads 71 on the interior of a hollow drive sleeve 72. During use of the rotary cleaning head 1, when the drive motor 30 is actuated it drives a gear box 76 having a drive gear (not illustrated, for clarity) that drives the drive sleeve 72 which, in turn, drives the spindle 6, thereby causing the rotary cleaning head 1 to rotate.

As best seen in FIGS. 1 and 4, cleaning fluid may be supplied to the rotary cleaning head 1 through the rotary coupling 28 in any suitable way, such as by screwing the output fitting 73 of the rotary coupling 28 into a hollow threaded pipe fitting 74, which is, in turn, screwed into the top of the hollow drive sleeve 72.

During use of the rotary cleaning head 1, the cleaning fluid travels from the rotary coupling 28 sequentially through its output fitting 73, the hollow pipe fitting 74, the cleaning fluid bore 35 in spindle 6, the cleaning fluid bore 56 in the central boss 54 of the vacuum main disc 2, the hollow hub 9 of sprayer 3, the spray arms 10 and the hollow elbows 11 to the spray nozzles 12.

As best seen in FIG. 4, vacuum may be supplied to the rotary cleaning head 1 by attaching a source of vacuum to the vacuum coupling 33. By way of example, if the rotary cleaning head 1 is equipped with vacuum heads 100, during use of the rotary cleaning head 1 air, used cleaning fluid, dirt and debris travel through the rotary cleaning head 1 following the path generally indicated by the flow line 75 in FIG. 4; i.e. they travel sequentially through the vacuum slots 67 and vacuum ports 66 in the vacuum heads 100; the vacuum ports 59 in the vacuum main disc 2; the vacuum channels 44 and 57 in the seal 14 and the upper side of the vacuum main disc 2; the vacuum distribution hubs 45, 58 in the seal 14 and the upper side of the vacuum main disc 2; the vacuum opening 41 in the cover 7; the inlet 81 of the vacuum plenum 32; the vacuum plenum 32; and the vacuum coupling 33.

It is understood that any particular part of the rotary cleaning head 1 may be suitably combined or formed with one or more of its other parts to form a composite part, without departing from the scope and spirit of the claimed invention. For example, the spacers 39 may be formed as part of the vacuum main disc 2; or the spindle 6 may be formed as part of the vacuum main disc 2.

Similarly, it is understood that any particular part of the rotary cleaning head 1 presently shown as being made in one piece may be formed by assembling together in any suitable way, two or more sub-pieces, without departing from the scope and spirit of the claimed invention. For example the rim 53 and central boss 54 of the vacuum main disc 2 might be made as separate sub-pieces, which may then be assembled to the rest of the vacuum main disc 2 in any suitable way, to form the completed vacuum main disc 2.

It is to be further understood that any different number of the screws, e.g. screws 15, 18, 19, and 20 (and their associated holes or bores, e.g., 38, 40, 46, 47, 48, 52, 61, 63, and 65) may be used in lieu of the number of those screws and their associated holes or bores that have been described and illustrated herein, without departing from the scope and spirit of the claimed invention. In addition, the direction of travel of one or more of those screws may be reversed without departing from the scope and spirit of the claimed invention. For example, the direction of travel of the mounting screws 19 for the glide feet 5 may be reversed, so that the mounting screws 19 first pass through the holes 47 in the vacuum main disc 2 and are then screwed into the mounting bores 63 of the glide feet 5.

It is to be additionally understood that the manner in which the various parts of the rotary cleaning head 1 may be assembled together that has been described herein is strictly by way of non-limiting example, since the various parts of the rotary cleaning head 1 may be assembled together in any other suitable way, by using any other suitable means, such as by using rivets, nuts and bolts, welding, gluing, screwing together, friction fits, keys, etc., in lieu of one or more of the screws 15, 18, 19, and 20 described herein, without departing from the scope and spirit of the claimed invention.

The rotary cleaning head 1 may be particularly adapted to be used to clean carpeted surfaces. However, in general, the rotary cleaning head 1 may be easily modified for use to clean any hard or soft surface, by suitably selecting any suitable and needed sprayers 3, vacuum heads 100, and glide shoes 5.

As used herein, except in the claims, the words "and" and "or" are each defined to also carry the meaning of "and/or".

If the term "at least one of" is used in any of the claims, that term is defined to mean that any one, any more than one, or all, of the listed things following that term is, or are, part of the claimed invention. For example, if a hypothetical claim recited "at least one of A, B, and C", then the claim is to be interpreted so that it may comprise (in addition to anything else recited in the claim), an A alone, a B alone, a C alone, both A and B, both A and C, both B and C, and all of A, B and C.

It is understood that the foregoing forms of the claimed invention were described and illustrated strictly by way of non-limiting example.

In view of all of the disclosures herein, these and further modifications, adaptations and variations of the claimed invention will now be apparent to those of ordinary skill in the art to which it pertains, within the scope of the following claims.

What is claimed is:

1. A vacuum head for a rotary cleaning head for a cleaning machine for a floor, wherein said rotary cleaning head is operable to use a cleaning fluid and comprises a circumference, an axis of rotation, a radius extending outwardly from said axis of rotation, a direction of rotation about said axis of rotation, and a vacuum port;

wherein said vacuum head is operable to be carried by said rotary cleaning head; wherein said vacuum head has a configuration that is at least generally L-shaped and comprises a vacuum port arm; a vacuum port at least partially defined by said vacuum port arm; a vacuum slot arm; a vacuum slot at least partially defined by said vacuum slot arm; and a leading side that faces in said rotary cleaning head's direction of rotation;

wherein, when said vacuum head is installed on said rotary cleaning head, said vacuum head's vacuum port arm extends at least generally along said rotary cleaning head's radius; wherein said vacuum head's vacuum slot arm extends forward from said vacuum head's vacuum port arm at least generally in said rotary cleaning head's direction of rotation; wherein said vacuum slot arm comprises a leading end portion that faces in said rotary cleaning head's direction of rotation; wherein said vacuum slot arm's leading end portion has a height; wherein said vacuum head's vacuum port is operable to receive a vacuum from said rotary cleaning head's vacuum port; and wherein said vacuum head's vacuum slot is operable to receive a vacuum from said vacuum head's vacuum port;

wherein, during use of said rotary cleaning head, at least some of said cleaning fluid comprises migrating cleaning fluid that moves radially outwardly along at least part of said vacuum head's leading side; wherein said vacuum head's vacuum slot is operable to vacuum up at least some of said migrating cleaning fluid, to help prevent at least some of said migrating cleaning fluid from being slung radially outwardly from said rotary cleaning head and wherein said height of said vacuum slot arm is tapered, to help enable said vacuum slot arm to be operable to ski up and over an obstacle on said floor during use of said rotary cleaning head.

2. The vacuum head of claim 1, wherein said vacuum head's vacuum port has a radial length; and wherein a ratio of said radial length of said vacuum head's vacuum port to said rotary cleaning head's radius is in the range of from about 1:3 to about 1:1.

3. The vacuum head of claim 1, wherein said vacuum head's vacuum slot has a circumferential length; and wherein a ratio of said circumferential length of said vacuum head's vacuum slot to said rotary cleaning head's circumference is in the range of from about 1:4 to about 1:1.

4. The vacuum head of claim 1, wherein said vacuum slot arm further comprises a trailing end portion; and wherein said leading end portion of said vacuum slot arm is located radially closer to said rotary cleaning head's axis of rotation than is said trailing end portion of said vacuum slot arm.

5. The vacuum head of claim 1, wherein said vacuum head's vacuum port arm comprises a leading side that faces in said rotary cleaning head's direction of rotation, and a trailing side; wherein said leading and trailing sides each have a respective height; and wherein said height of said leading side is less than said height of said trailing side, to enable said vacuum port to be operable to vacuum up a larger amount of said cleaning fluid than would be the case if said vacuum port arm's leading and trailing sides were of the same height.

6. The vacuum head of claim 1, wherein said vacuum head's vacuum slot arm comprises radially inner and outer sides, wherein the radially inner and outer sides each have a respective height; and wherein said height of said radially inner side is less than said height of said radially outer side, to enable said vacuum head's vacuum slot to be operable to vacuum up a larger amount of said cleaning fluid than would be the case if said vacuum slot arm's radially inner and outer sides were of the same height.

7. The vacuum head of claim 1 wherein said vacuum port arm comprises a leading side that faces in said rotary cleaning head's direction of rotation; wherein said vacuum port arm's leading side has a height; and wherein said height of said vacuum port arm's leading side is tapered, to help enable said vacuum port arm to be operable to ski up and over an obstacle on said floor.

8. The rotary cleaning head of claim 1, wherein said vacuum head further comprises a vacuum head ridge; and wherein said vacuum head ridge is sized and located to be operable to route into said vacuum head vacuum slot at least some of said migrating cleaning fluid, to help prevent at least some of that migrating cleaning fluid from being slung outwardly during use of said rotary cleaning head.

9. The vacuum head of claim 1, wherein said vacuum slot has a leading end portion and a trailing end portion; and wherein said leading end portion of said vacuum slot faces in said rotary cleaning head's direction of rotation, and is located radially closer to said rotary cleaning head's axis of rotation than is said trailing end portion of said vacuum slot.

10. A vacuum head for a rotary cleaning head for a cleaning machine for a floor, wherein said rotary cleaning head is operable to use a cleaning fluid and comprises a circumference, an axis of rotation, a radius extending outwardly from said axis of rotation, a direction of rotation about said axis of rotation, and a vacuum port;

wherein said vacuum head is operable to be carried by said rotary cleaning head and comprises a vacuum port, a vacuum slot, and a leading side that faces in said rotary cleaning head's direction of rotation;

wherein, when said vacuum head is installed on said rotary cleaning head, said vacuum head's vacuum port is operable to receive a vacuum from said rotary cleaning head's vacuum port; wherein said vacuum head's vacuum slot is operable to receive a vacuum from said vacuum head's vacuum port; wherein said vacuum head's vacuum port extends at least generally along said rotary cleaning head's radius; and wherein said vacuum head's vacuum slot extends forward from said vacuum head's vacuum port at least generally in said rotary cleaning head's direction of rotation;

wherein, during use of said rotary cleaning head, at least some of said cleaning fluid comprises migrating cleaning fluid that moves radially outwardly along at least part of said vacuum head's leading side; wherein said vacuum head's vacuum slot is operable to vacuum up at least some of said migrating cleaning fluid, to help prevent at least some of said migrating cleaning fluid from being slung radially outwardly from said rotary cleaning head;

wherein said vacuum head's vacuum slot has a circumferential length; and wherein a ratio of said circumferential length of said vacuum head's vacuum slot to said rotary cleaning head's circumference is in the range of from about 1:4 to about 1:1.

11. A vacuum head for a rotary cleaning head for a cleaning machine for a floor, wherein said rotary cleaning head is operable to use a cleaning fluid and comprises a circumference, an axis of rotation, a radius extending outwardly from said axis of rotation, a direction of rotation about said axis of rotation, and a vacuum port;

wherein said vacuum head is operable to be carried by said rotary cleaning head and comprises a vacuum port, a vacuum slot, and a leading side that faces in said rotary cleaning head's direction of rotation;

wherein, when said vacuum head is installed on said rotary cleaning head, said vacuum head's vacuum port is operable to receive a vacuum from said rotary cleaning head's vacuum port; wherein said vacuum head's vacuum slot is operable to receive a vacuum from said vacuum head's vacuum port; wherein said vacuum head's vacuum port extends at least generally along said rotary cleaning head's radius; wherein said vacuum head's vacuum slot extends forward from said vacuum head's vacuum port at least generally in said rotary cleaning head's direction of rotation;

wherein, during use of said rotary cleaning head, at least some of said cleaning fluid comprises migrating cleaning fluid that moves radially outwardly along at least part of said vacuum head's leading side; wherein said vacuum head's vacuum slot is operable to vacuum up at least some of said migrating cleaning fluid, to help prevent at least some of said migrating cleaning fluid from being slung radially outwardly from said rotary cleaning head; and wherein said vacuum head is at least generally L-shaped.

12. The vacuum head of claim 11, wherein said vacuum head comprises a vacuum port arm that at least partially defines said vacuum port; and a vacuum slot arm that at least partially defines said vacuum slot; and wherein, when said vacuum head is installed on said rotary cleaning head, said vacuum head's vacuum port arm extends at least generally along said rotary cleaning head's radius; and wherein said vacuum head's vacuum slot arm extends forward from said vacuum head's vacuum port arm at least generally in said rotary cleaning head's direction of rotation.

13. The vacuum head of claim 12, wherein said vacuum slot arm further comprises a leading end portion that faces in said rotary cleaning head's direction of rotation, and a trailing end portion; and wherein said leading end portion of said vacuum slot arm is located radially closer to said rotary cleaning head's axis of rotation than is said trailing end portion of said vacuum slot arm.

14. The vacuum head of claim 12 wherein said vacuum head's vacuum port arm comprises a leading side that faces in said rotary cleaning head's direction of rotation, and a trailing side; wherein said leading and trailing sides each have a respective height; and wherein said height of said leading side is less than said height of said trailing side, to enable said vacuum port to be operable to vacuum up a larger amount of said cleaning fluid than would be the case if said vacuum port arm's leading and trailing sides were of the same height.

15. The vacuum head of claim 12, wherein said vacuum head's vacuum slot arm comprises radially inner and outer sides, wherein the radially inner and outer sides each have a respective height; and wherein said height of said radially inner side is less than said height of said radially outer side, to enable said vacuum head's vacuum slot to be operable to vacuum up a larger amount of said cleaning fluid than would be the case if said vacuum slot arm's radially inner and outer sides were of the same height.

16. The vacuum head of claim 12, wherein said vacuum port arm comprises a leading side that faces in said rotary cleaning head's direction of rotation; wherein said vacuum port arm's leading side has a height; and wherein said height of said vacuum port arm's leading side is tapered, to help enable said vacuum port arm to be operable to ski up and over an obstacle on said floor.

17. The vacuum head of claim 12, wherein said vacuum slot arm comprises a leading end portion that faces in said rotary cleaning head's direction of rotation; wherein said vacuum slot arm's leading end portion has a height; and wherein said height of said vacuum slot arm is tapered, to help enable said vacuum slot arm to be operable to ski up and over an obstacle on said floor.

18. The vacuum head of claim 12, wherein said vacuum slot has a leading end portion and a trailing end portion; and wherein said leading end portion of said vacuum slot faces in said rotary cleaning head's direction of rotation, and is located radially closer to said rotary cleaning head's axis of rotation than is said trailing end portion of said vacuum slot.

19. A vacuum head for a rotary cleaning head for a cleaning machine for a floor, wherein said rotary cleaning head is operable to use a cleaning fluid and comprises a circumference, an axis of rotation, a radius extending outwardly from said axis of rotation, a direction of rotation about said axis of rotation, and a vacuum port;

wherein said vacuum head is operable to be carried by said rotary cleaning head and comprises a vacuum port, a vacuum slot, and a leading side that faces in said rotary cleaning head's direction of rotation;

wherein, when said vacuum head is installed on said rotary cleaning head, said vacuum head's vacuum port is operable to receive a vacuum from said rotary cleaning head's vacuum port; wherein said vacuum head's vacuum slot is operable to receive a vacuum from said vacuum head's vacuum port; wherein said vacuum head's vacuum port extends at least generally along said rotary cleaning head's radius; and wherein said vacuum head's vacuum slot extends forward from said vacuum head's vacuum port at least generally in said rotary cleaning head's direction of rotation;

wherein, during use of said rotary cleaning head, at least some of said cleaning fluid comprises migrating cleaning fluid that moves radially outwardly along at least part of said vacuum head's leading side;

wherein said vacuum head's vacuum slot is operable to vacuum up at least some of said migrating cleaning fluid, to help prevent at least some of said migrating cleaning fluid from being slung radially outwardly from said rotary cleaning head;

wherein said vacuum head has a configuration that is at least generally L-shaped;

wherein said vacuum head comprises a vacuum port arm that at least partially defines said vacuum port; and a vacuum slot arm that at least partially defines said vacuum slot;

wherein, when said vacuum head is installed on said rotary cleaning head, said vacuum head's vacuum port arm extends at least generally along said rotary cleaning head's radius; and wherein said vacuum head's vacuum slot arm extends forward from said vacuum head's vacuum port arm at least generally in said rotary cleaning head's direction of rotation.

20. The vacuum head of claim 19, wherein said vacuum slot arm further comprises a leading end portion that faces in said rotary cleaning head's direction of rotation, and a trailing end portion; and wherein said leading end portion of said vacuum slot arm is located radially closer to said rotary cleaning head's axis of rotation than is said trailing end portion of said vacuum slot arm.

21. The vacuum head of claim 19, wherein said vacuum head's vacuum port arm comprises a leading side that faces in said rotary cleaning head's direction of rotation, and a trailing side; wherein said leading and trailing sides each have a respective height; and wherein said height of said leading side is less than said height of said trailing side, to enable said vacuum port to be operable to vacuum up a larger amount of said cleaning fluid than would be the case if said vacuum port arm's leading and trailing sides were of the same height.

22. The vacuum head of claim 19, wherein said vacuum head's vacuum slot arm comprises radially inner and outer sides, wherein the radially inner and outer sides each have a respective height; and wherein said height of said radially inner side is less than said height of said radially outer side, to enable said vacuum head's vacuum slot to be operable to vacuum up a larger amount of said cleaning fluid than would be the case if said vacuum slot arm's radially inner and outer sides were of the same height.

23. The vacuum head of claim 19, wherein said vacuum port arm comprises a leading side that faces in said rotary cleaning head's direction of rotation; wherein said vacuum port arm's leading side has a height; and wherein said height of said vacuum port arm's leading side is tapered, to help enable said vacuum port arm to be operable to ski up and over an obstacle on said floor.

24. The vacuum head of claim 19, wherein said vacuum slot arm comprises a leading end portion that faces in said rotary cleaning head's direction of rotation; wherein said vacuum slot arm's leading end portion has a height; and wherein said height of said vacuum slot arm is tapered, to help enable said vacuum slot arm to be operable to ski up and over an obstacle on said floor.

* * * * *